US007448841B2

(12) United States Patent
Ishikawa et al.

(10) Patent No.: US 7,448,841 B2
(45) Date of Patent: Nov. 11, 2008

(54) FRONT DEVICE

(75) Inventors: Hironao Ishikawa, Tsukuba (JP); Shingo Kishimoto, Kouka (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 222 days.

(21) Appl. No.: 10/588,502

(22) PCT Filed: Jun. 7, 2005

(86) PCT No.: PCT/JP2005/010755

§ 371 (c)(1),
(2), (4) Date: Aug. 4, 2006

(87) PCT Pub. No.: WO2006/008892

PCT Pub. Date: Jan. 26, 2006

(65) Prior Publication Data

US 2007/0124963 A1 Jun. 7, 2007

(30) Foreign Application Priority Data

Jul. 22, 2004 (JP) ..... 2004-214631

(51) Int. Cl.
*E02F 9/14* (2006.01)

(52) U.S. Cl. ..... 414/722; 52/111; 414/694

(58) Field of Classification Search ..... 414/694, 414/722; 52/111, 115–118; 296/30
See application file for complete search history.

(56) References Cited

U.S. PATENT DOCUMENTS

| | | | | |
|---|---|---|---|---|
| 4,392,314 | A * | 7/1983 | Albrecht et al. | 414/694 |
| 5,611,657 | A * | 3/1997 | Peterson | 414/722 |
| 2004/0161326 | A1 * | 8/2004 | Yamaguchi et al. | 414/722 |

FOREIGN PATENT DOCUMENTS

| | | |
|---|---|---|
| JP | 53-31539 | 12/1993 |
| JP | 9-242108 | 9/1997 |
| JP | 9-242109 | 9/1997 |
| JP | 11-200397 | 7/1999 |
| JP | 2001-81810 | 3/2001 |

* cited by examiner

*Primary Examiner*—Donald Underwood
(74) *Attorney, Agent, or Firm*—Mattingly, Stanger, Malur & Brundidge, PC

(57) ABSTRACT

An upper boom is constituted by a box member having a shape like a box that includes an upper flange, a lower flange, a left web and a right web, and bosses that are welded to both ends of the box member. Bent plate portions which are bent inward are provided at both ends of the left web, and bent plate portions are also provided at both ends of the right web. Reinforcement plates are positioned at an outside of the bent plate portions and welded between the left web and the boss, and reinforcement plates are also welded between the right web and the boss at an outside of the bent plate portions. With these bent plate portions and the reinforcement plates, a double structure can be provided in the vicinities of the bosses, and these portions can be reinforced.

5 Claims, 15 Drawing Sheets

FRONT DEVICE

TECHNICAL FIELD

This invention relates to a front device that is mounted on a construction machine, such as a hydraulic excavator or a hydraulic crane, and is appropriately employed, for example, as a boom or an arm for a working mechanism.

BACKGROUND ART

Generally, for a construction machine such as a hydraulic excavator or a hydraulic crane, a working mechanism for performing excavating or loading, for example, is liftably provided. As such a working mechanism, a hydraulic excavator that includes a front device such as a boom or an arm is well known (e.g., see Japanese Patent Laid-Open No. 2001-81810).

Consider the boom of a hydraulic excavator as an example of a front device according to this first prior art. This boom includes a box member, which is formed as a hollow structure having the shape of a box by welding together an upper flange, a lower flange, a left web and a right web, and a boss which is located on the base end of the box member, and is liftably coupled with the vehicle body of a hydraulic excavator.

In this case, the boss is formed by a cylinder which is made of a metallic material having a high strength, and the ends of the upper flange, the lower flange, the left web and the right web of the box member are welded at the external surface. Further, a bracket which the arm of the working mechanism is rotatably connected is provided at the distal end of the box member.

Furthermore, according to the first prior art, various reinforcement structures are provided to obtain the strength of the hollow box member. In this case, in the first prior art, for example, a concave rib is formed at the middle position in the longitudinal direction of the left web of the boom.

Further, as a second prior art, a structure is well known wherein, for example, the upper flange, the lower flange, the left web and the right web of a box member are formed of thick steel plates, and a blocking plate is provided inside of the box member to block the internal space at the middle position in the longitudinal direction (e.g., Japanese Patent Laid-Open No. Sho 53-31539).

In the first prior art mentioned above, since the boss which has a high strength is welded to the upper flange, the lower flange, the left web, the right web which have lower strengths, there is a demand at this stage in the designing of a front device that the strength be obtained at the position whereat these two materials which have different strengths are welded together.

However, according to the structure of the first prior art, the rib is located in the middle in the longitudinal direction of the left web of the boom. The rib can increase the flexural strength of the left web, but there is a limit to greatly increasing the strength of the box member as a whole. Thus, there is a problem that it is difficult for a satisfactory strength to be obtained near the boss.

Further, according to the structure of the second prior art, the upper flange, the lower flange, the left web and the right web of the box member are formed of thick steel plates and the blocking plate is provided inside. However, when thick steel plates are simply employed, the weight of the boom is increased, which causes problems, i.e., an increase in the size of an actuator that drives the boom and results in the reduction of the operation efficiency. In addition, even when the blocking plate is provided inside of the box member, the strength may be insufficient near the boss because this blocking plate is located separate from the boss.

DISCLOSURE OF THE INVENTION

In the view of the above described problems with the prior art, it is an object of the present invention to provide a front device that can suppress an increase in the weight of a box member, can easily improve the strength of the box member in the vicinity of a boss, and can improve durability.

(1) To achieve the above described objective, the present invention is applied for a front device including a box member formed by welding together an upper flange, a lower flange, a left web and a right web, and a boss located at least at one end of the box member and welded to the ends of the upper flange, the lower flange, the left web and the right web.

And the characteristics of the arrangement adopted by the present invention are that a bent plate portion which is bent inward is provided for at least one side web of the left web or the right web, and a reinforcement plate is located outside of the bent plate portion and arranged between the one side web and the boss.

According to this arrangement, at the position on the end side to be welded to the boss, the bent plate portion can be provided for either the left web or the right web of the box member, or for both the left and right webs, and the reinforcement plate can be located outside of the bent plate portion. Therefore, since the portions of the box member to be welded to the boss can obtain a double structure by use of the bent plate portion and the reinforcement plate, the strength of this portion can be increased, and a high rigidity can also be obtained to an external force in a torsional direction.

In this case, the boss is formed as a metallic cylindrical member having a high strength. Whereas the upper flange, the lower flange, the left web, the right web which constitute the box member are made of steel plates and have a lower strength than the boss. Thus, it is preferable that the portion whereat the two materials having the different strengths are welded be formed at a high strength. Therefore, when the bent plate portion and the reinforcement plate are arranged at the end side of the box member, the portion whereat two materials having different strengths are welded can be appropriately protected.

Furthermore, since the reinforcement plate is located outside of the bent plate portion, for example, the portions of the left web or the right web which are other than the bent plate portion and the reinforcement plate can be arranged continuously and substantially on the same vertical plane. Therefore, since the reinforcement plate does not greatly project outside of the box member, the front device can be made compactly, and a high rigidity can be obtained.

And, since the necessary portions of the box member can be reinforced by use of the bent plate portion and the reinforcement plate, the upper flange, the lower flange, the left web and the right web having a minimum required thickness can be used at positions separate from the boss. As a result, in the vicinity of the boss, a high strength that can not be obtained by employing a rib, a blocking plate, etc., is ensured, and the weight of the box member as a whole can be held down, so that a small, light and very durable front device can be provided.

(2) In addition, according to the arrangement of the present invention, a bent plate portion which is bent inward is provided for at least one side flange of the upper flange or the lower flange, and a reinforcement plate is located outside of the bent plate portion and arranged between the one side flange and the boss.

Since the bent plate portion is provided for either the upper flange or the lower flange of the box member, or for both upper and lower flanges, and the reinforcement plate can be arranged, the portion to be welded to the boss can provide a double structure, and the strength of the box member can be increased at this place. Further, since the reinforcement plate does not greatly project outside of the box member, the front device can be made compactly. Therefore, in the vicinity of the boss, a high strength which can not be obtained by employing a rib, a blocking plate is ensured, and the weight of the box member as a whole can be held down, so that a small and light front device having a high strength can be provided.

(3) Further, according to the arrangement of the present invention, one bent plate portion which is bent inward is provided for at least one side web of the left web or the right web, and another bent plate portion which is bent inward is provided for at least one side flange of the upper flange or the lower flange, one reinforcement plate is located outside of the one bent plate portion and arranged between the one side web and the boss, and another reinforcement plate is located outside of the other bent plate portion and arranged between the one side flange and the boss.

Thus, since the bent plate portion is provided for the upper flange or the lower flange of the box member, and the reinforcement plate can be arranged thereat, and since the bent plate portion is provided for the left web or the right web, and the reinforcement plate can be arranged thereat, the above described two effects can be obtained. Further, for example, the bent plate portions are provided for the upper flange, the lower flange, the left web and the right web individually, and the reinforcement plates can be arranged outside of the individual bent plate portions. According to this arrangement, for example, the upper and lower bent plate portions and the left and right bent plate portions can be welded together to form a shape like a box, and the four upper, lower, left and right reinforcement plates can be welded to form a shape like a box at the position which enclose the bent plate portions from outside. In this manner, a box member shaped like a double box can be formed in the vicinity of the boss, and at this position, the strength of the front device can be appropriately increased.

(4) Further, according to the present invention, the box member serves as at least one component of a lower boom which is liftably coupled with the body of a construction machine, an upper boom which is pivotally coupled with the distal end of the lower boom for swinging movements in leftward and rightward directions, or an arm which is rotatably coupled with the distal end of the upper boom through an arm support member and to which a work tool is attached.

With this arrangement, the bent plate portion and the reinforcement plate can be provided for front device, such as a lower boom, an upper boom and an arm, that constitute an offset boom working mechanism, for example. Therefore, the strength of each of the front devices can be increased as needed, and objects for the application can be expanded.

(5) Moreover, according to the present invention, the box member serves as at least one component of a boom which is liftably coupled with the body of a construction machine, and an arm which is rotatably coupled with the distal end of the boom and to which a work tool is attached.

With this arrangement, the bent plate portion and the reinforcement plate can be provided for front devices, such as a boom and an arm, that constitute a working mechanism other than a type of offset boom, and objects for the application can be expanded.

BEST MODE FOR CARRYING OUT THE INVENTION

Hereafter, with reference to FIGS. 1 through 22, a front device of the present invention is described more particularly.

Figure 1:
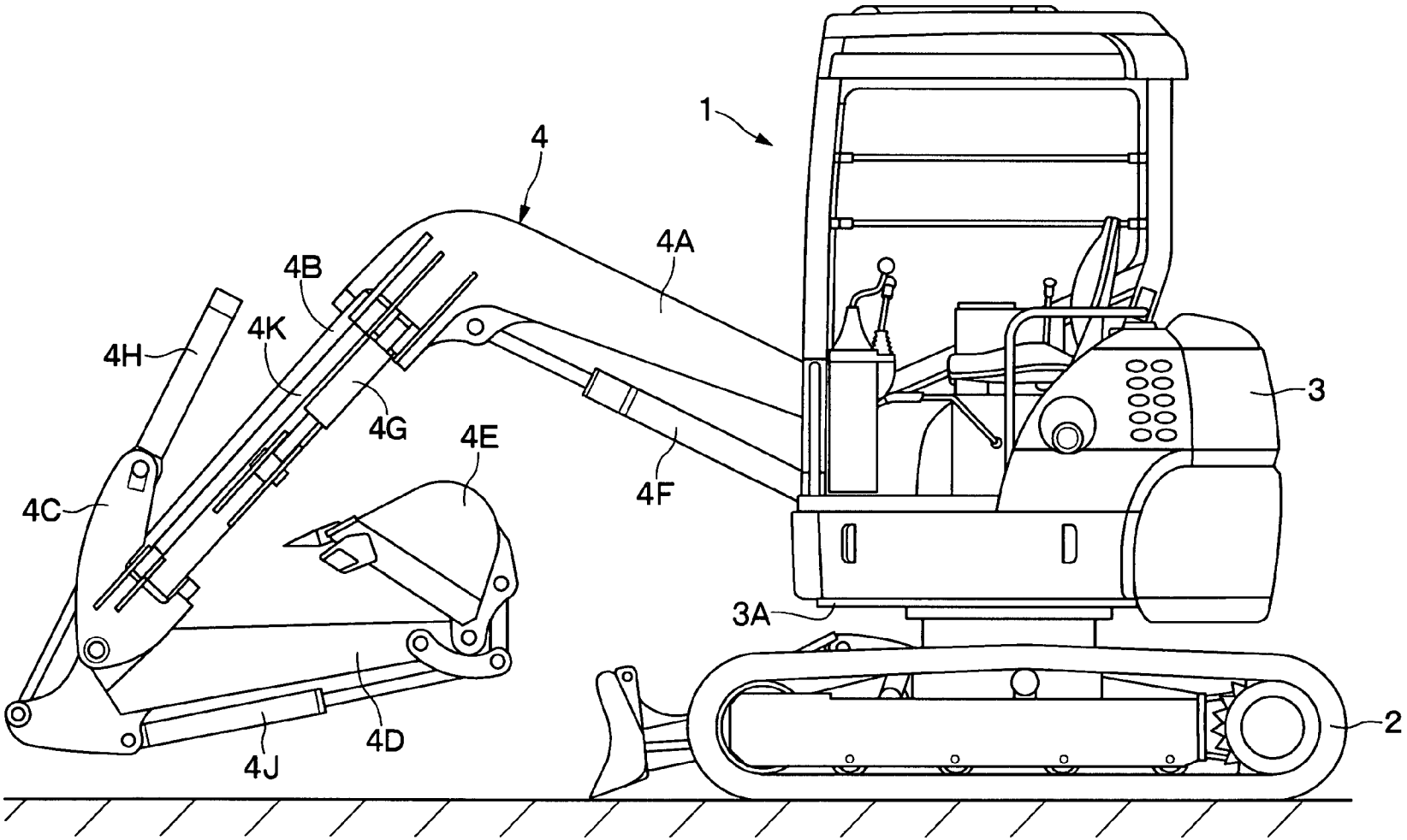
FIG. 1 is a front view of a hydraulic excavator of an offset boom type applied for an embodiment of the present invention.
Figure 2:
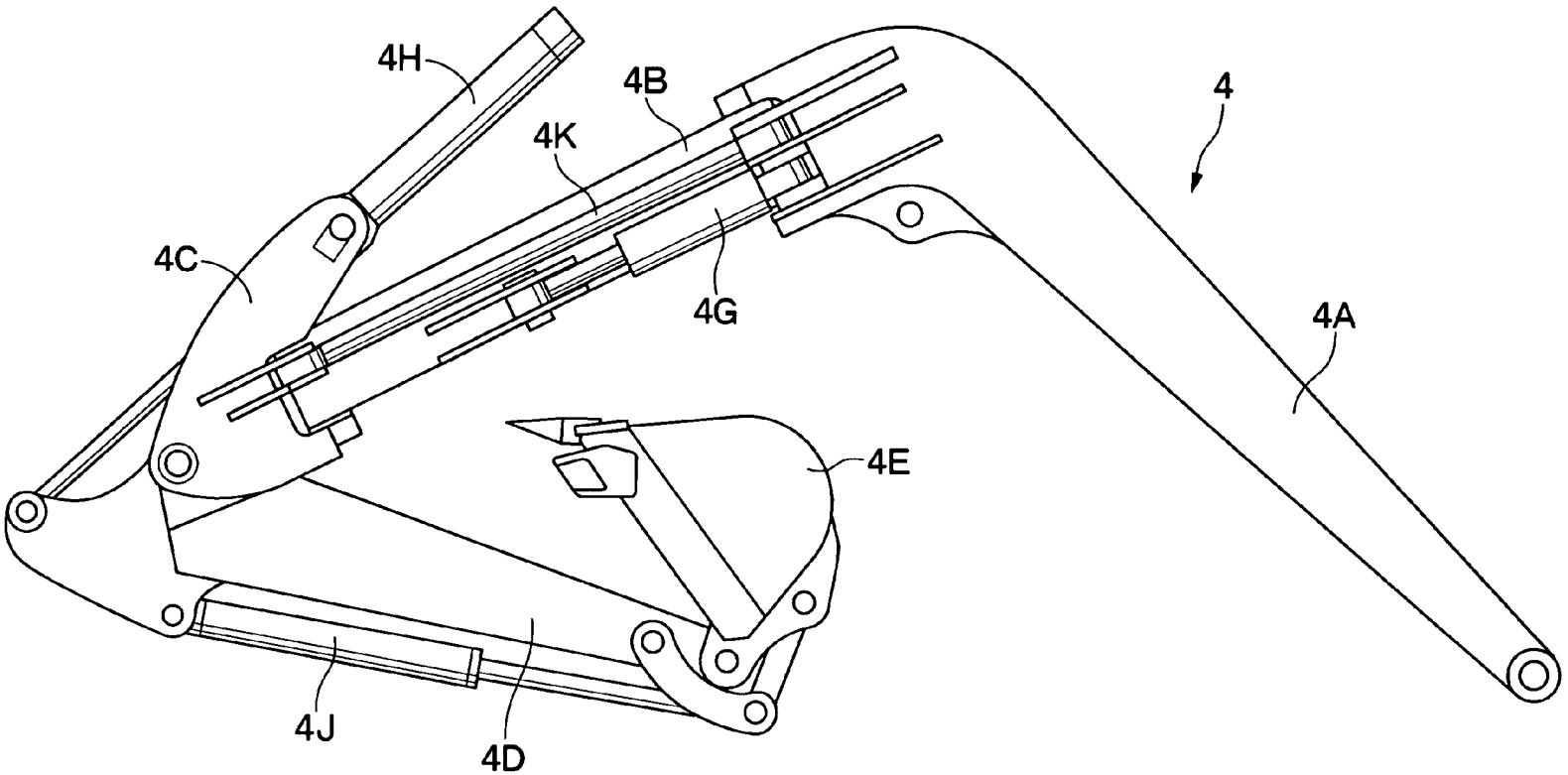
FIG. 2 is a front view of a working mechanism in FIG. 1.

First, with reference to FIGS. 1 and 2, a hydraulic excavator of an offset boom type will be explained as a construction machine for which the front device according to the embodiments of the present invention is applied.

In the drawings, indicated at 1 is a hydraulic excavator of an offset boom type applied for the first embodiment. The hydraulic excavator 1 is roughly constituted by a vehicular lower structure 2, an upper revolving structure 3 which is rotatably mounted on the vehicular lower structure 2, and a working mechanism 4, which will be described later, that is liftably attached to the front of the upper revolving structure 3 for performing the excavation of dirt, etc. Further, the vehicular lower structure 2 and the upper revolving structure 3 constitute the body of the hydraulic excavator 1.

Denoted at 4 is a working mechanism of an offset boom type, and this working mechanism 4 is liftably attached to the upper revolving structure 3. As shown in FIGS. 1 and 2, the working mechanism 4 is constituted by a lower boom 4A which is liftably coupled to the upper revolving structure 3, an upper boom 4B which is swingably coupled to the distal end of the lower boom 4A for swinging movements in leftward and rightward directions, an arm support member 4C which is swingably coupled to the distal end of the upper boom 4B for swinging movements in leftward and rightward directions, an arm 4D which is rotatably coupled to the distal end of the arm support member 4C for upward and downward rotational movements, a bucket 4E which is rotatably attached as a work tool to the distal end of the arm 4D, cylinders 4F, 4G, 4H, 4J and a link 4K.

The boom cylinder 4F is positioned between the upper revolving structure 3 and the lower boom 4A, for lifting up and down the lower boom 4A vertically. The offset cylinder 4G is positioned between the lower boom 4A and the upper boom 4B for swinging the upper boom 4B to the leftward and rightward directions. The arm cylinder 4H is positioned between the arm support member 4C and the arm 4D for rotating the arm 4D vertically. The bucket cylinder 4J is positioned between the arm 4D and the bucket 4E for rotating the bucket 4E.

On the other hand, the link 4K is positioned between the lower boom 4A and the arm support member 4C and constitutes a parallel link mechanism together with the lower boom 4A, the upper boom 4B and the arm support member 4C. And as the offset cylinder 4G is extended or retracted, the upper boom 4B is moved to the leftward and rightward directions in accordance with this extension/retraction. At this time, the arm support member 4C is moved by the link 4K in the opposite direction to the movement of the upper boom 4B. Therefore, the arm 4D and the bucket 4E are moved (offset) to the left side or right side of the body, while the state of parallel to the lower boom 4A is maintained. Through the above described operation of the parallel link mechanism, the hydraulic excavator 1 can perform excavating such as ditch digging at this offset position.

With reference to FIGS. 3 through 8, the front device, according to the first embodiment of the present invention, is described more particularly by way of example to the upper boom of a hydraulic excavator of an offset boom type.

Indicated at 11 is an upper boom which is a front device. The upper boom 11 is used as the upper boom 4B of the working mechanism 4 of an offset boom type shown in FIGS. 1 and 2. The upper boom 11 is formed as an elongated hollow structure having the shape (square) of a box in a transverse sectional shape, and extends from the front to the rear direction of the body. The upper boom 11 also includes a box member 12, bosses 18, 19 and reinforcement plates 20, 21, which will be described later.

Indicated at 12 is a box member that constitutes the main body of the upper boom 11. As shown in FIGS. 3 through 6, the box member 12 is constituted by an upper flange 13, a lower flange 14, a left web 15 and a right web 16, which will be described later. Through the bonding (welding) of these steel plates, the entire box member 12 is formed as a square column that extends from the front to the rear direction.

Reference numeral 13 denotes an upper flange that serves as the upper face of the box member 12, and the upper flange 13 is formed, for example, of a flat steel plate. Further, two metal plates 13A are welded to the upper face of the upper flange 13 to reinforce between the base ends thereof and the bosses 18, 19.

Denoted at 14 is a lower flange that serves as the lower face of the box member 12. The lower flange 14 is formed of substantially the same steel plate as is the upper flange 13, and is faced to the upper flange 13 at a vertical interval. Further, a bracket 14A is securely fixed to the left end face of the lower flange 14. And the offset cylinder 4G (see FIG. 2) is rotatably attached between the bracket 14A and a bracket 15D of the left web 15, that will be described later.

Indicated at 15 is a left web that serves as the left side face of the box member 12, and is formed, for example, of an elongated steel plate with both end sides of which are bent inward. The left web 15 is located substantially upright between the upper flange 13 and the lower flange 14, and is welded between the upper flange 13 and the lower flange 14 along its entire length.

In this case, the left web 15 is constituted by a side face plate portion 15A which serves as the left side face of the upper boom 11 together with left reinforcement plates 20, which will be described later, a bent plate portion 15B which is integrally formed with the base end of the side face plate portion 15A, and another bent plate portion 15C which is integrally formed with the distal end of the side face plate portion 15A. And the side face plate portion 15A is located in the middle portion of the box member 12, and is extended in the longitudinal direction. Further, the bracket 15D of the offset cylinder 4G is securely fixed outside of the side face plate portion 15A.

The two bent plate portions 15B, 15C are arranged inside of the individual left reinforcement plates 20, and are extended in the longitudinal direction of the box member 12. Further, the bent plate portions 15B and 15C are bent inward (obliquely inward) in the direction of the right web 16, and are positioned between the upper flange 13 and the lower flange 14. The three sides of the bent plate portion 15B on the base end are welded to the upper flange 13, the lower flange 14 and the base end boss 18. Further, the three sides of the bent plate portion 15C on the distal end are welded to the upper flange 13, the lower flange 14 and the distal end boss 19.

Indicated at 16 is a right web that serves as the right side face of the box member 12, and substantially in the same manner as the left web 15, the right web 16 is formed, for example, of an elongated steel plate with both end sides of which are bent. And the right web 16 is welded between the upper flange 13 and the lower flange 14 along its entire length. In this case, the right web 16 is constituted by a side face plate portion 16A which serves as the right side face of the upper boom 11 together with right reinforcement plates 21, which will be described later, a bent plate portion 16B which is integrally formed on the base end of the side face plate portion 16A, and another bent plate portion 16C which is integrally formed with the distal end of the side face plate portion 16A.

Furthermore, the bent plate portions 16B, 16C are extended inside of the right reinforcement plates 21 in the longitudinal direction of the box member 12 and are bent inwardly in the direction of the left web 15. And the three sides of the bent plate portion 16B on the base end are welded to the upper flange 13, the lower flange 14 and the base end boss 18. Further, the three sides of the bent plate portion 15C on the distal end are welded to the upper flange 13, the lower flange 14 and the distal end boss 19. In addition, the left web 15 and the right web 16 face each other, at a horizontally interval, and a coupling plate 17 is welded for reinforcement between the side face plate portions 15A, 16A.

Denoted at 18 is a base end boss that is provided on the base end of the box member 12, and is formed by a cylinder which is made of a metallic material, for example. The ends of the upper flange 13 and the lower flange 14, the ends of the bent plate portions 15B, 16B of the left and right webs 15, 16 and the reinforcement plates 20, 21, which will be described later, are welded to the outer face of the base end boss 18.

Indicated at 19 is a distal end boss that is provided on the distal end of the box member 12, and is also formed by a cylinder which is made of a metallic material, for example. Substantially in the same manner as the base end boss 18, the upper flange 13, the lower flange 14, the bent plate portions 15C, 16C of the left and right webs 15, 16 and the reinforcement plates 20, 21 are welded to the outer face of the distal end boss 19.

And, the base end boss 18 of the upper boom 11 is pivotally connected to the lower boom 4A (see FIG. 2) by use of a connecting pin for swinging movements in leftward and rightward directions, and the distal end boss 19 is pivotally connected to the arm support member 4C by use of a connecting pin for swinging movements in leftward and rightward directions.

Figure 3:
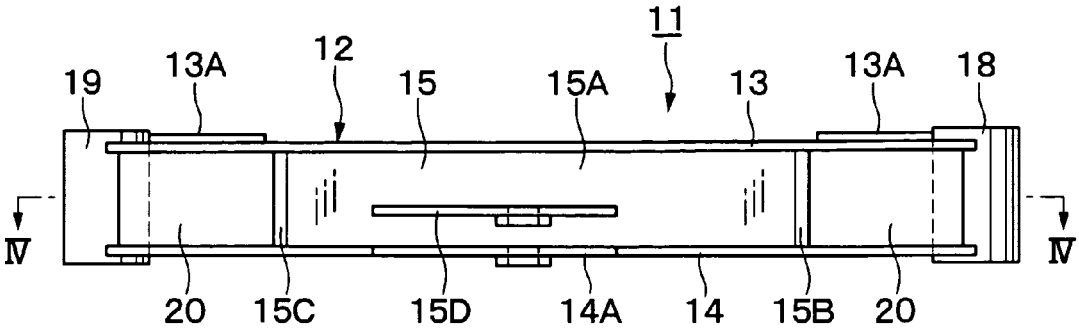
FIG. 3 is a front view of an upper boom shown alone according to a first embodiment of the present invention.
Figure 4:
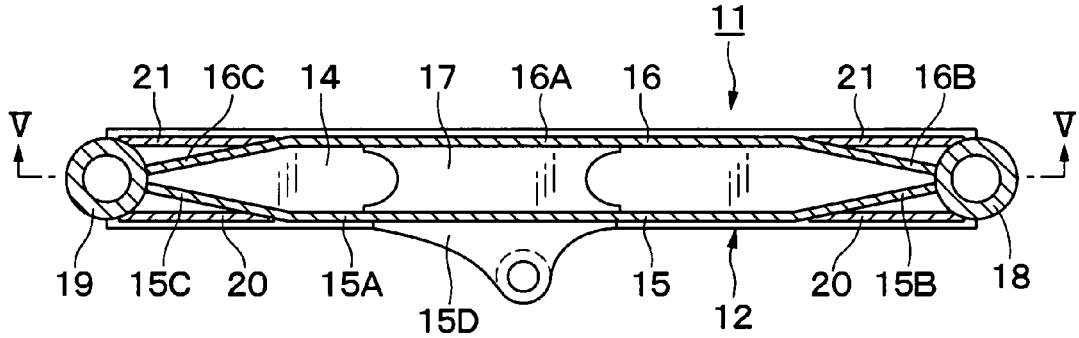
FIG. 4 is a longitudinal sectional view of the upper boom, taken in the direction of arrows IV-IV in FIG. 3.
Figure 5:
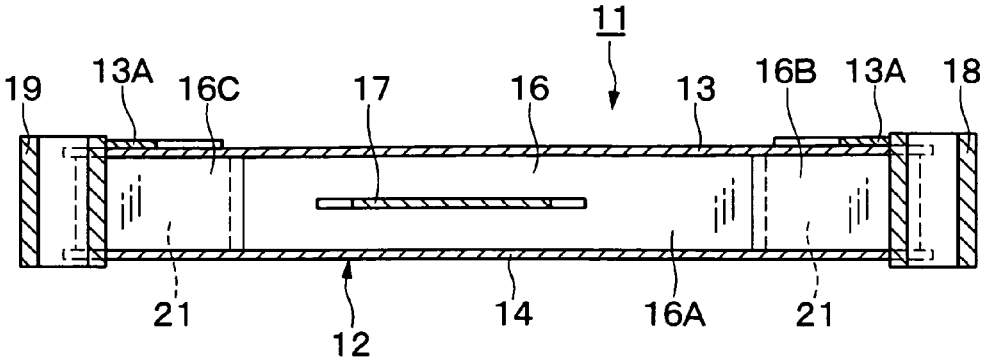
FIG. 5 is a longitudinal sectional view of the upper boom, taken in the direction of arrows V-V in FIG. 4.
Figure 6:
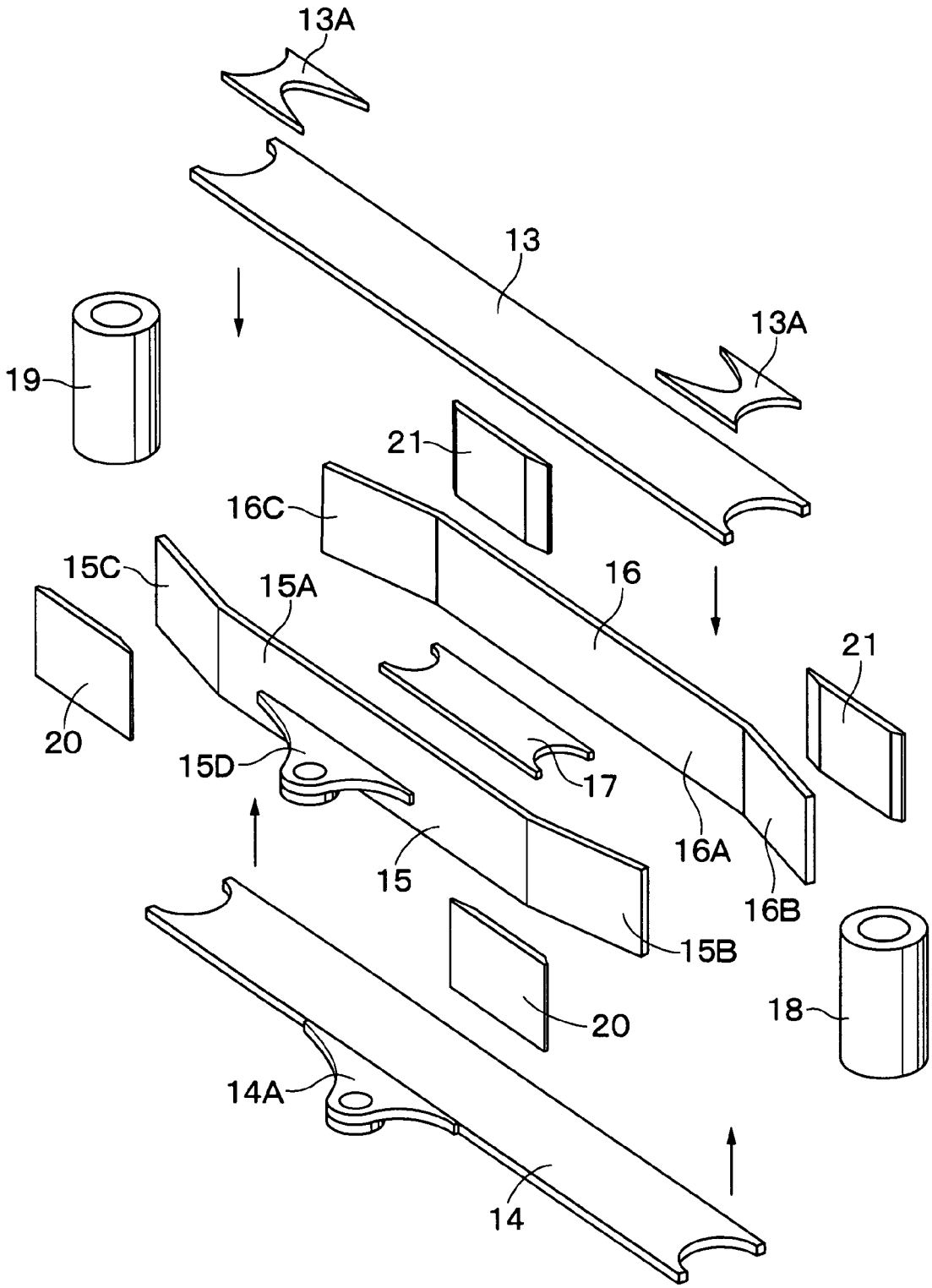
FIG. 6 is an enlarged exploded perspective view of the upper boom in the exploded state.
Figure 7:
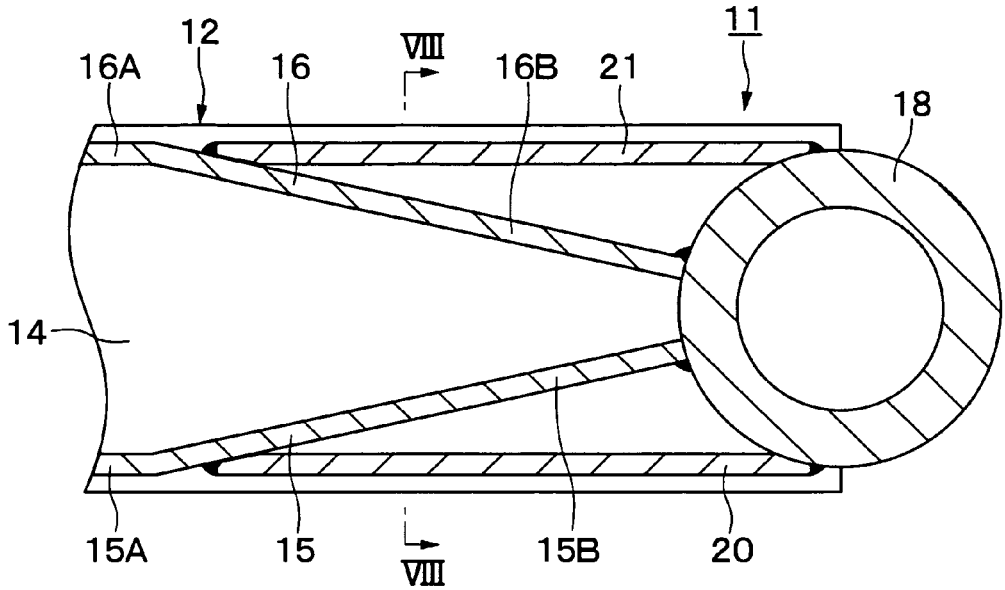
FIG. 7 is an enlarged fragmentary sectional view of the base end of the upper boom in FIG. 4.

Denoted at 20, 20 are two left reinforcement plates which are provided outside of the bent plate portions 15B, 15C of the left web 15. As shown in FIGS. 3 and 4, these left reinforcement plates 20 consist of flat rectangular steel plates, and are extended in the longitudinal direction while overlapping with the outside of the bent plate portions 15B and 15C of the left web 15. Thus, the left reinforcement plates 20, together with right reinforcement plates 21, which will be described later, provide a double structure for the portions on the end sides whereat the bosses 18, 19 of the box member 12 are welded, so that these portions are reinforced.

One of the left reinforcement plates 20 located on the base end of the box member 12 is welded between the bent plate portion 15B and the base end boss 18, and is also welded between the upper flange 13 and the lower flange 14. Further, substantially in the same manner as the left reinforcement plate 20 located on the base end, the left reinforcement plate 20 located on the distal end of the box member 12 is welded to the upper flange 13, the lower flange 14, the bent plate portion 15C and the distal end boss 19.

Moreover, the left reinforcement plates 20 are arranged continuously and substantially on the same vertical plane as the side face plate portion 15A of the left web 15. With this arrangement, since the left reinforcement plates 20 do not greatly project outside of the box member 12, the upper boom 11 can be made compactly.

Indicated at 21, 21 are two right reinforcement plates which are provided outside of the bent plate portions 16B, 16C of the right web 16. As shown in FIGS. 4 through 8, these right reinforcement plates 21, substantially in the same manner as the left reinforcement plates 20, are formed of rectangular steel plates, for example, and are extended in the longitudinal direction while overlapping with the outside of the bent plate portions 16B, 16C of the right web 16.

And the right reinforcement plate 21 on the base end is welded between the bent plate portion 16B and the base end boss 18, and is also welded between the upper flange 13 and the lower flange 14. Substantially in the same manner, the right reinforcement plate 21 on the distal end is welded to the upper flange 13, the lower flange 14, the bent plate portion 16C and the distal end boss 19. Furthermore, the right reinforcement plates 21 are arranged continuously and substantially on the same vertical plate as the side face plate portion 16A of the right web 16.

Figure 8:
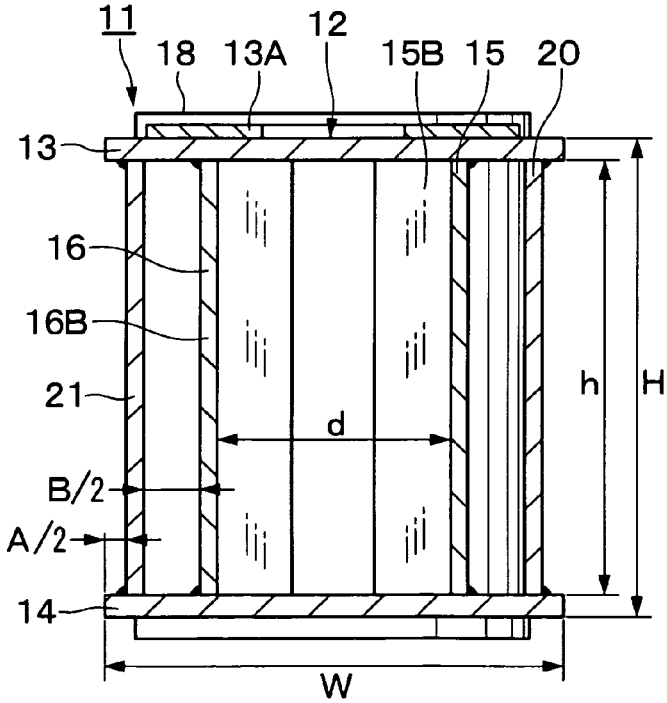
FIG. 8 is an enlarged transverse cross-sectional view of the base end of the upper boom, taken in the direction of arrows VIII-VIII in FIG. 7.

As a result, as shown in FIG. 8, as portions on both the left and right sides are doubled by employing the upper flange 13, the lower flange 14, the bent plate portions 15B, 16B of the left and right webs 15, 16 and the reinforcement plates 20, 21, a cross-sectional structure having the shape of a box can be provided for the base end of the box member 12. Furthermore, a cross-sectional structure which is doubled by employing the bent plate portions 15C, 16C and the reinforcement plates 20, 21 can also be provided for the distal end of the box member 12. Therefore, both ends of the box member 12 can be reinforced by this double structure, and the box member 12 and the bosses 18, 19 can be securely welded.

With reference to FIG. 8, the relationship between the cross-sectional structure of the box member 12 and its strength will be specifically explained by considering the vicinity of the base end boss 18 as an example.

Firstly, with reference to FIG. 8, assume that a vertical size H is provided for the box member 12 and that the upper flange 13 and the lower flange 14 are arranged apart with a distance h. Further, the upper flange 13 and the lower flange 14 have a transverse width W, and project outward from the reinforcement plates 20, 21 horizontally a distance (A/2). On the other hand, it is assumed that the bent plate portions 15B, 16B of the left and right webs 15, 16 are faced to each other at specified positions with a transverse distance d, and moreover, outside of these bent plate portions 15B, 16B, the reinforcement plates 20, 21 are arranged with an intervening gap (B/2).

In this case, a cross-sectional second moment I of the box member 12 can be represented by the following expression (1), which uses the individual sizes H, h, A, B, d and W.

$$I=\tfrac{1}{12}(WH^3-dh^3-Ah^3-Bh^3) \quad (1)$$

Figure 9:
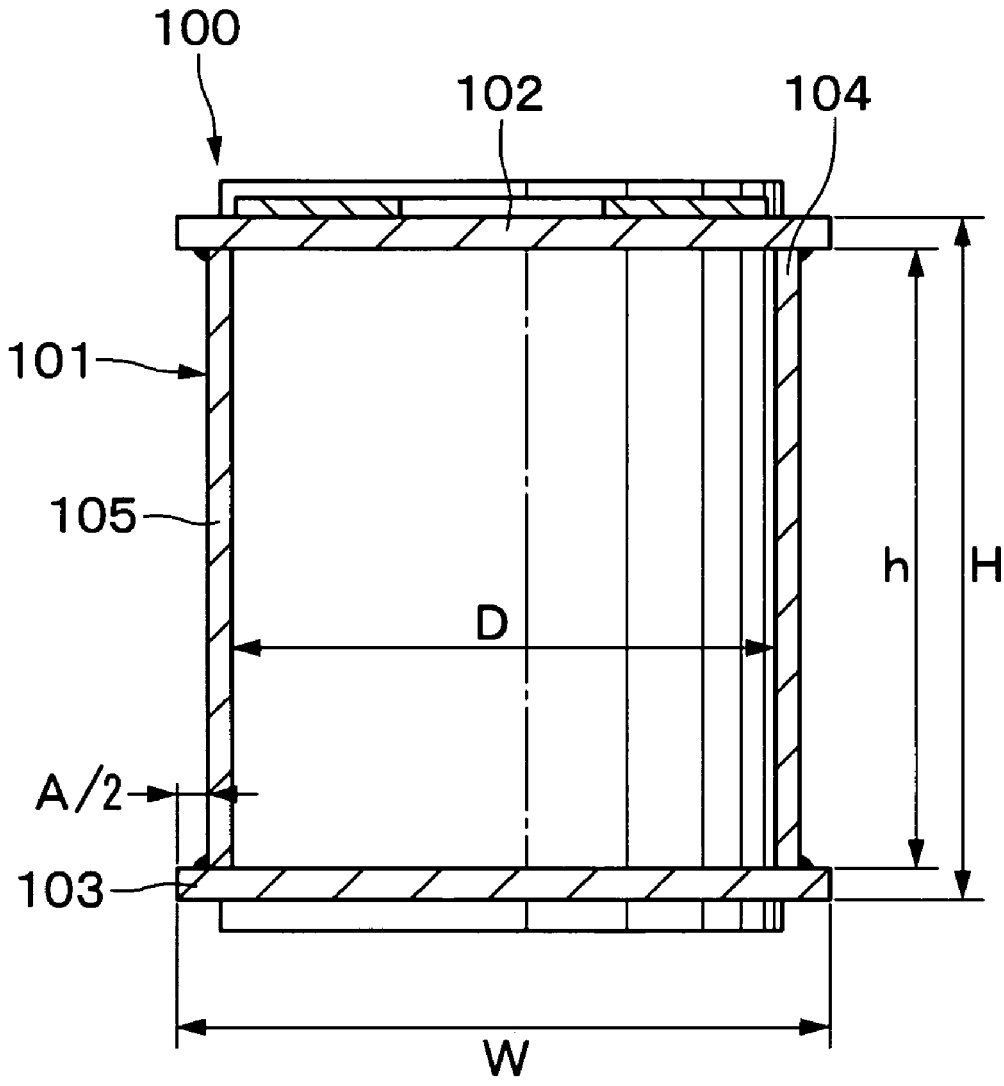
FIG. 9 is a transverse cross-sectional view of an upper boom provided as an comparison example, taken from the same direction as in FIG. 8.

On the other hand, when the upper boom in the prior art is formed by steel plates having the same thickness as this embodiment, a comparison example shown in FIG. 9, for example, is obtained. For an upper boom 100 in the comparison example, sizes H, h, A and W, related to an upper flange 102, a lower flange 103, a left web 104 and a right web 105 of a box member 101, are defined in the same manner as the upper boom 11 in this embodiment. Further, when the interval between the left and right webs 104, 105 is defined as D, a cross-sectional second moment J of the box member 101 can be represented by the following expression (2).

$$J=\tfrac{1}{12}(WH^3-Dh^3-Ah^3) \quad (2)$$

In this case, as is apparent from FIGS. 8 and 9, an additional value (B+d) of sizes B and d which are included in the expression (1) is smaller than the interval D which is included in the expression (2) by a value equivalent to the thickness of the bent plate portions 15B, 16B. Thus, the following expression (3) is established.

$$D>d+B \quad (3)$$

While considering the expression (3), the following expression (4) can be obtained by the results, which are obtained by the expressions (1) and (2) are compared.

$$I>J \quad (4)$$

Therefore, the cross-sectional second moment I on the base end of the box member 12 for the first embodiment can be increased more than the cross-sectional second moment J for the box member 101 in the comparison example. As a result, since the cross-sectional coefficient of the upper boom 11 can be increased, the strength of the upper boom 11 on the base end can be increased. Similarly, the strength of the upper boom 11 on the distal end can also be increased.

Therefore, according to the arrangement of the first embodiment, the bent plate portions 15B, 15C are provided for the left web 15 of the upper boom 11, and the left reinforcement plates 20 are arranged outside, while in the same manner, the bent plate portions 16B, 16C are provided for the right web 16, and the right reinforcement plates 21 are arranged outside.

Thus, since the portions of the box member 12 that to be welded to the bosses 18, 19 can be a double structure, the strength at these portions can be appropriately increased, and a high rigidity is ensured relative to an external force in the torsional direction, for example.

In this case, the bosses 18, 19 are formed as metallic cylinders having a high strength, while the upper flange 13, the lower flange 14, the left web 15, the right web 16, are formed of steel plates, and the strength of these plates are less than the bosses 18, 19. Therefore, it is preferable that the portions whereat two materials having different strengths are welded be formed at a high strength. According to this embodiment, since the bent plate portions 15B, 15C, 16B, 16C and the reinforcement plates 20, 21 are arranged on the ends of the box member 12, the portions whereat two materials having different strengths are welded can be appropriately protected.

Especially in the first embodiment, the bent plate portions 15B, 15C and the left reinforcement plates 20 are provided for the left web 15, and the bent plate portions 16B, 16C and the right reinforcement plate 21 are provided for the right web 16. Therefore, the cross-sectional structure having the shape of a box, wherein the portions on the left and right sides are doubled, can be formed on both ends of the upper boom 11, and a satisfactory high strength can be obtained.

Furthermore, the left reinforcement plates 20 are located outside of the bent plate portions 15B, 15C of the left web 15, and the right reinforcement plates 21 are located outside of the bent plate portions 16B, 16C of the right web 16. As a result, the side face plate portions 15A, 16A of the left and right webs 15, 16 and the reinforcement plates 20, 21 can be arranged continuously and substantially on the same vertical plane. Thus, since the reinforcement plates 20, 21 do not greatly project horizontally from the box member 12, the upper boom 11 can be formed compactly, and high strength can be obtained.

In addition, since the necessary portions of the box member 12 can be reinforced by use of the bent plate portions 15B, 15C, 16B, 16C and the reinforcement plates 20, 21, the upper flange 13, the lower flange 14, the left web 15 and the right web 16 having minimum required thickness can be applied at positions separate from the bosses 18, 19. Thus, high strength that can not be obtained by use of a rib, a blocking plate is ensured in the vicinities of the bosses 18, 19, the weight of the box member 12 can be held down as a whole, and the small, light upper boom 11, which has a high durability, can be provided.

Further, the bent plate portions 15B, 16B of the left and right web 15, 16 are bent inward. When the upper and lower flanges 13, 14 are welded to the base end boss 18, the welding portion of these flanges can be extended. Similarly, the bent plate portions 15C, 16C are bent inward. When the upper and lower flanges 13, 14 are welded to the distal end boss 19, the welding portion of these flanges can be extended. Thus, the strength of the joints of the upper and lower flanges 13, 14 and the bosses 18, 19 can be increased, and they can be securely connected.

Figure 10:
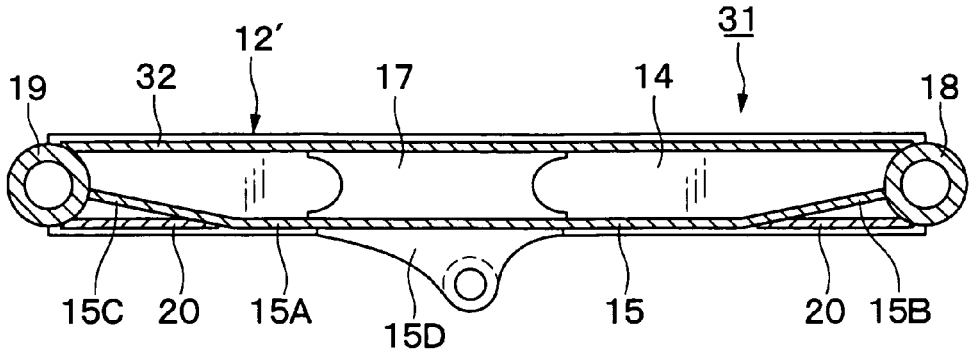
FIG. 10 is a longitudinal sectional view of an upper boom according to a second embodiment of the present invention, taken from the same direction as in FIG. 4.

The second embodiment for a front device according to the present invention is shown in FIG. 10. The characteristics of this embodiment are that bent plate portions are provided only for one of a left web and a right web, and reinforcement plates are arranged outside. In the following description of the second embodiment, those component parts which are identical with counterparts in the foregoing first embodiment are simply designated by the same reference numerals or characters to avoid repetitions of same explanations.

Indicated at 31 is an upper boom, as a front device. Substantially in the same manner as the first embodiment, the upper boom 31 is constituted by a box member 12' which is formed of an upper flange (not shown), a lower flange 14, a left web 15, a right web 32, bosses 18, 19, and left reinforcement plates 20.

The right web 32 is formed of a flat steel plate that does not have a bent plate portion, for example. On the other hand, the left web 15 has the same structure of the first embodiment, and bent plate portions 15B, 15C are provided on both sides of a side face plate portion 15A. In this case, the right web 32 is welded to the upper flange 13, the lower flange 14 and the bosses 18, 19. Further the left web 15 is welded to the upper flange 13, the lower flange 14, the bosses 18, 19 and the left reinforcement plates 20. Therefore, according to the arrangement of the upper boom 31 for this embodiment, bent plate portions and reinforcement plates are not provided on the right side, and the bent plate portions 15B, 15C and the left reinforcement plates 20 are provided only on the left side.

Being arranged in the same manner as described above, the second embodiment can obtain substantially the same operational effects as the foregoing first embodiment of the invention. Especially in this embodiment, since the bent plate portions 15B, 15C are provided for the left web 15 of the upper boom 31, and the left reinforcement plates 20 are arranged outside of these portions, and the right web 32 is formed of a flat steel plate, the minimum required strength is ensured in the vicinities of the bosses 18, 19, the structure of the upper boom 31 can be simplified, and the degree of freedom in the design can be increased.

Figure 11:
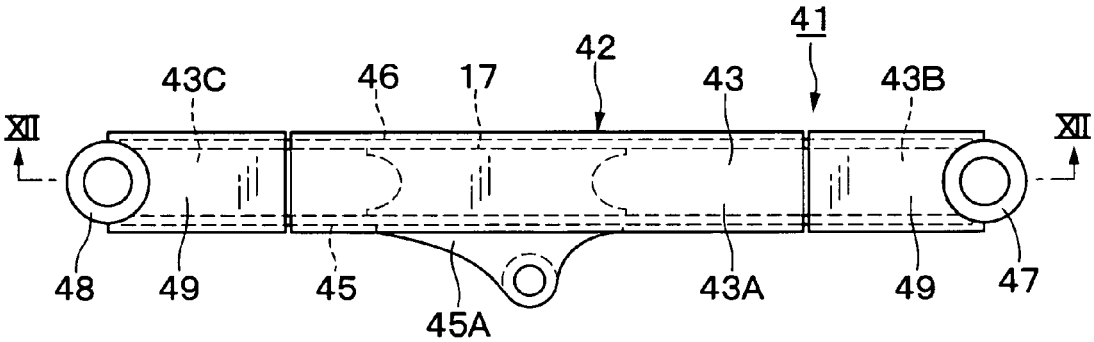
FIG. 11 is a plan view of an upper boom according to a third embodiment of the present invention, taken from above.
Figure 12:
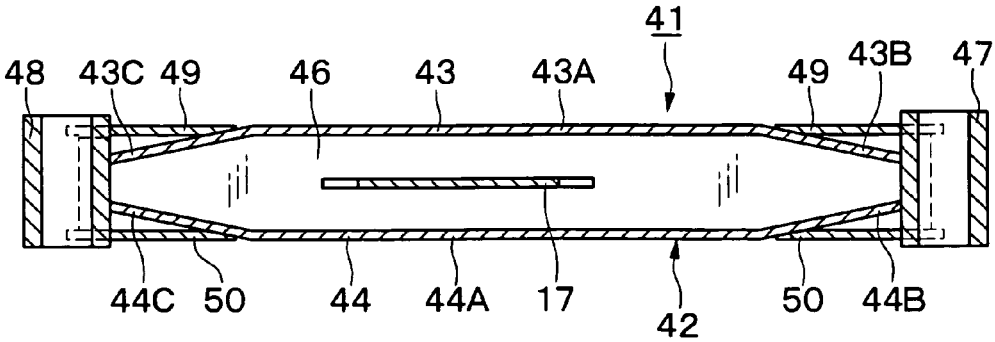
FIG. 12 is a longitudinal sectional view of the upper boom, taken in the direction of arrows XII-XII in FIG. 11.
Figure 13:
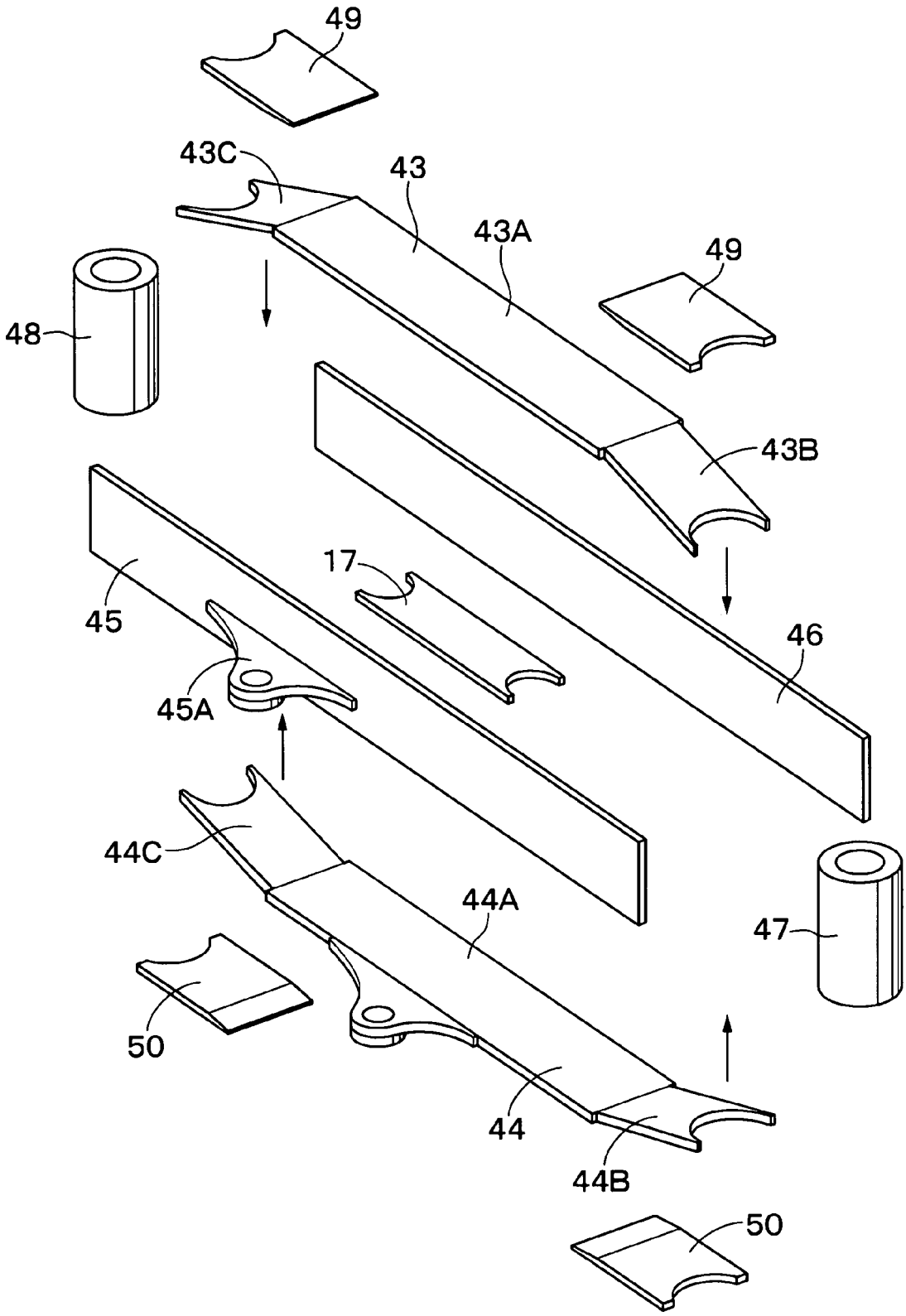
FIG. 13 is an enlarged exploded perspective view of the upper boom in the exploded state.

The third embodiment for a front device according to the present invention is shown in FIGS. 11 through 13. The characteristics of this embodiment are that bent plate portions are provided for an upper flange and a lower flange of an upper boom, and reinforcement plates are arranged outside of these portions. In the following description of the third embodiment, those component parts which are identical with counterparts in the foregoing first embodiment are simply designated by the same reference numerals or characters to avoid repetitions of same explanations.

Indicated at 41 is an upper boom as a front device. Substantially in the same manner as the first embodiment, the upper boom 41 is constituted by a box member 42 which will be described later, bosses 47 and 48, and reinforcement plates 49, 50.

Indicated at 42 is a box member that constitutes the main body of the upper boom 41. As shown in FIGS. 11 and 12, the box member 42 is formed like a square column as a whole by welding an upper flange 43, a lower flange 44, a left web 45, a right web 46 which will be described later, substantially in the same manner as the first embodiment.

Denoted at 43 is an upper flange that serves as the upper face of the box member 42, and is formed of a steel plate, both ends of which are bent. The upper flange 43 is constituted by an upper face plate portion 43A which serves as the upper face of the upper boom 41 together with upper reinforcement plates 49, a bent plate portion 43B which is integrally formed with the base end of the upper face plate portion 43A, and another bent plate portion 43C which is integrally formed with the distal end of the upper face plate portion 43A.

The bent plate portions 43B, 43C of the upper flange 43 are bent obliquely inward in the direction of the lower flange 44, extended in the longitudinal direction of the box member 42, and are arranged between the left web 45 and the right web 46. Further, of the bent plate portions 43B, 43C, the bent plate portion 43B which is near the base end is welded to the left and right webs 45, 46 and the base end boss 47, while the bent plate portion 43C which is near the distal end is welded to the left and right webs 45, 46 and the distal end boss 48.

Reference numeral 44 denotes a lower flange that serves as the lower face of the box member 42 and that is formed of a steel plate, both ends of which are bent. This lower flange 44 is constituted by a lower face plate portion 44A which serves as the lower face of the upper boom 41 together with lower reinforcement plates 50, that will be described later, a bent plate portion 44B which is integrally formed with the base end of the lower face plate portion 44A, and a bent plate portion 44C which is integrally formed with the distal end of the lower face plate portion 44A. The bent plate portion 44B at the base end is welded to the left and right webs 45, 46 and to the base end boss 47, while the bent plate portion 44C at the distal end is welded to the left and right webs 45, 46 and to the distal end boss 48.

Denoted at 45 is a left web that serves as the left side face of the box member 42, and indicated at 46 is a right web that serves as the right side face of the box member 42. These left and right webs 45, 46 are formed of flat steel plates, for example, and are welded to the upper flange 43, the lower flange 44 and to the bosses 47, 48. Further, a bracket 45A for an offset cylinder is securely fixed to the left web 45.

Indicated at 47 is a base end boss, and denoted at 48 is a distal end boss. These bosses 47, 48 are formed substantially in the same manner as the first embodiment. In this case, the bent plate portion 43B of the upper flange 43, the bent plate portion 44B of the lower flange 44, the left web 45, the right web 46 and the reinforcement plates 49, 50 are welded to the outer surface of the base end boss 47. Further, the bent plate portion 43C of the upper flange 43, the bent plate portion 44C of the lower flange 44, the left web 45, the right web 46 and the reinforcement plates 49, 50 are welded to the outer surface of the distal end boss 48.

Denoted at 49, 49 are two upper reinforcement plates which are provided outside of the each bent plate portions 43B, 43C of the upper flange 43. Substantially in the same manner as the left reinforcement plates 20 for the first embodiment, these upper reinforcement plates 49, together with lower reinforcement plates 50, which will be described later, provide a double structure for the portions at the ends of the box member 42, whereat the bosses 47, 48 are welded, so that these portions are reinforced.

Of the each upper reinforcement plates 49, the upper reinforcement plate 49 located near the base end of the box member 42 is welded to the bent plate portion 43B of the upper flange 43, to the left and right webs 45, 46 and to the base end boss 47. Similarly the each upper reinforcement plate 49 which is located near the base end of the box member 42, the upper reinforcement plate 49 which is located near the distal end is welded to the bent plate portion 43B of the upper flange 43, to the left and right webs 45, 46 and to the distal end boss 48. In addition, the each upper reinforcement plates 49 are arranged continuously and substantially on the same plane as the upper face plate portion 43A of the upper flange 43, so that the upper reinforcement plates 49 do not greatly project vertically from the box member 42.

Indicated at 50 are two lower reinforcement plates that are provided outside of the bent plate portions 44B, 44C of the lower flange 44. Substantially in the same manner as the upper reinforcement plates 49, the lower reinforcement plates 50 are arranged that they overlap with the outside of the bent plate portions 44B, 44C. The lower reinforcement plate 50 which is near the base end is welded to the bent plate portion 44B, to the left and right webs 45, 46 and to the base end boss 47. Further, the lower reinforcement plate 50 which is near the distal end is welded to the bent plate portion 44C, to the left and right webs 45, 46 and to the distal end boss 48. In addition, the lower reinforcement plates 50 are arranged continuously and substantially on the same plane as the lower face plate portion 44A of the lower flange 44.

Being arranged in the manner as described above, the third embodiment can obtain substantially the same effects as the first embodiment. That is, according to the arrangement of this embodiment, the bent plate portions 43B, 43C are provided for the upper flange 43 of the box member 42, and the upper reinforcement plates 49 are arranged thereat, while the bent plate portions 44B, 44C are provided for the lower flange 44 and the lower reinforcement plates 50 are arranged thereat.

Therefore, as the top and bottom portions are doubled by employing the bent plate portion 43B of the upper flange 43, the bent plate portion 44B of the lower flange 44, the left and right webs 45, 46 and the reinforcement plates 49, 50, the cross-sectional structure having the shape of a box, can be obtained at the base ends of the box member 42. Further, the cross-sectional structure which is doubled by employing the bent plate portions 43C, 44C, the left and right webs 45, 46 and the reinforcement plates 49, 50 can also be obtained at the distal end of the box member 42.

Thus, the strength of the box member 42 can be improved in the vicinities of the bosses 47, 48. Furthermore, for example, even it is difficult to reinforce the side portion of the upper boom 41 because of a structural limitation, the upper face portion and the lower face potion can be double-structured, and the degree of freedom in the design can be increased.

The fourth embodiment for a front device according to the present invention is shown in FIGS. 14 through 18. The characteristics of this embodiment are that bent plate portions are provided for an upper flange, a lower flange, a left web and a right web of an upper boom, and that reinforcement plates are provided outside of these bent plate portions. In the following description of the fourth embodiment, those component parts which are identical with counterparts in the foregoing first embodiment are simply designated by the same reference numerals or characters to avoid repetitions of same explanations.

Figure 14:
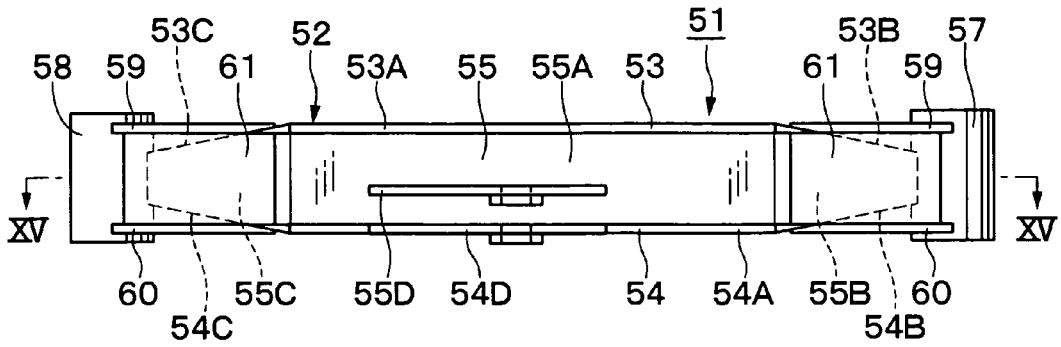
FIG. 14 is a front view of an upper boom according to a fourth embodiment of the present invention.
Figure 15:
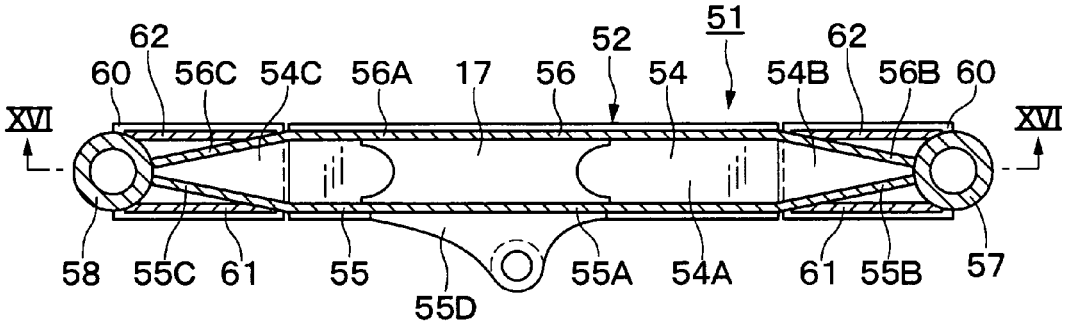
FIG. 15 is a longitudinal sectional view of the upper boom, taken in the direction of arrows XV-XV in FIG. 14.
Figure 16:
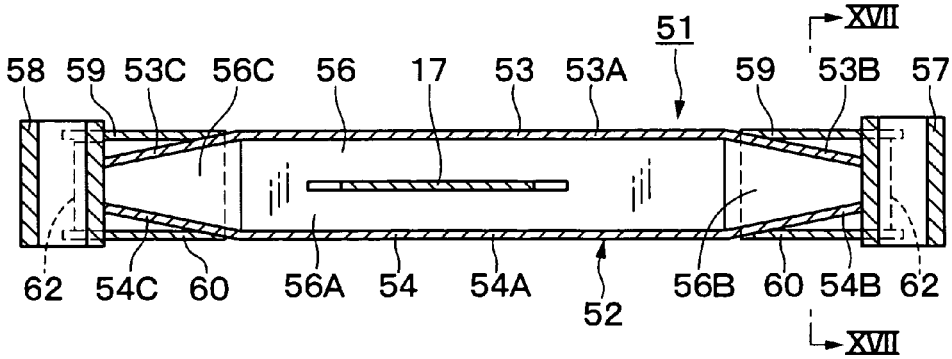
FIG. 16 is a longitudinal sectional view of the upper boom, taken in the direction of arrows XVI-XVI in FIG. 15.

Reference numeral 51 denotes an upper boom as a front device. As shown in FIGS. 14 through 16, the upper boom 51 is constituted by a box member 52 which is a hollow structure having the shape of a box formed of an upper flange 53, a lower flange 54, a left web 55, a right web 56, that will be described later, bosses 57, 58 which are respectively provided at the base end and the distal end of the box member 52, and reinforcement plates 59 through 62, which will be described later.

The upper flange 53, the lower flange 54, the left web 55 and the right web 56 are formed of steel plates, both ends of which are bent. In this case, substantially in the same manner as the third embodiment, the upper flange 53 is constituted by an upper face plate portion 53A and bent plate portions-53B, 53C, while the lower flange 54 is constituted by a lower face plate portion 54A and bent plate portions 54B, 54C.

Furthermore, similarly to the first embodiment, the left web 55 is constituted by a side face plate portion 55A and bent plate portions 55B, 55C, while the right web 56 is constituted by a side face plate portion 56A and bent plate portions 56B, 56C. Brackets 54D, 55D of offset cylinders are securely fixed respectively to the lower flange 54 and the left web 55.

Middle portion of the box member 52 is formed like a square column by welding together the upper face plate portion 53A, the lower face plate portion 54A, the left side face plate portion 55A and the right side face plate portion 56A, which are the four sides of the middle portion. The base end portion is formed like a pyramid by welding together the bent plate portions 53B, 54B, 55B, 56B, which are the four sides of the base end portion. And the distal end portion is formed like a pyramid by welding together the bent plate portions 53C, 54C, 55C, 56C, which are the four sides of the distal end portion.

Moreover, the ends of the bent plate portions 53B, 54B, 55B, 56B are welded to the base end boss 57, and the ends of the bent plate portions 53C, 54C, 55C, 56C are welded to the distal end boss 58.

Denoted at 59, 59 are two upper reinforcement plates that are respectively provided outside of the bent plate portions 53B, 53C of the upper flange 53. The upper reinforcement plate 59 near the base end is welded between the bent plate portion 53B and the base end boss 57, and the upper reinforcement plate 59 near the distal end is welded between the bent plate portion 53C and the distal end boss 58. Indicated at 60, 60 are lower reinforcement plates that are respectively provided outside of the bent plate portions 54B, 54C of the lower flange 54. Substantially in the same manner as the upper reinforcement plates 59, the lower reinforcement plate 60 near the base end is welded between the bent plate portion 54B and the base end boss 57, and the lower reinforcement plate 60 near the distal end is welded between the bent plate portion 54C and the distal end boss 58.

Further, indicated at 61, 61 are two left reinforcement plates that are respectively provided outside of the bent plate portions 55B, 55C of the left web 55, and indicated at 62, 62 are right reinforcement plates that are respectively provided outside of the bent plate portions 56B, 56C of the right web 56. The left reinforcement plates 61 and the right reinforcement plates 62 are structured substantially in the same manner as the first embodiment.

Figure 17:
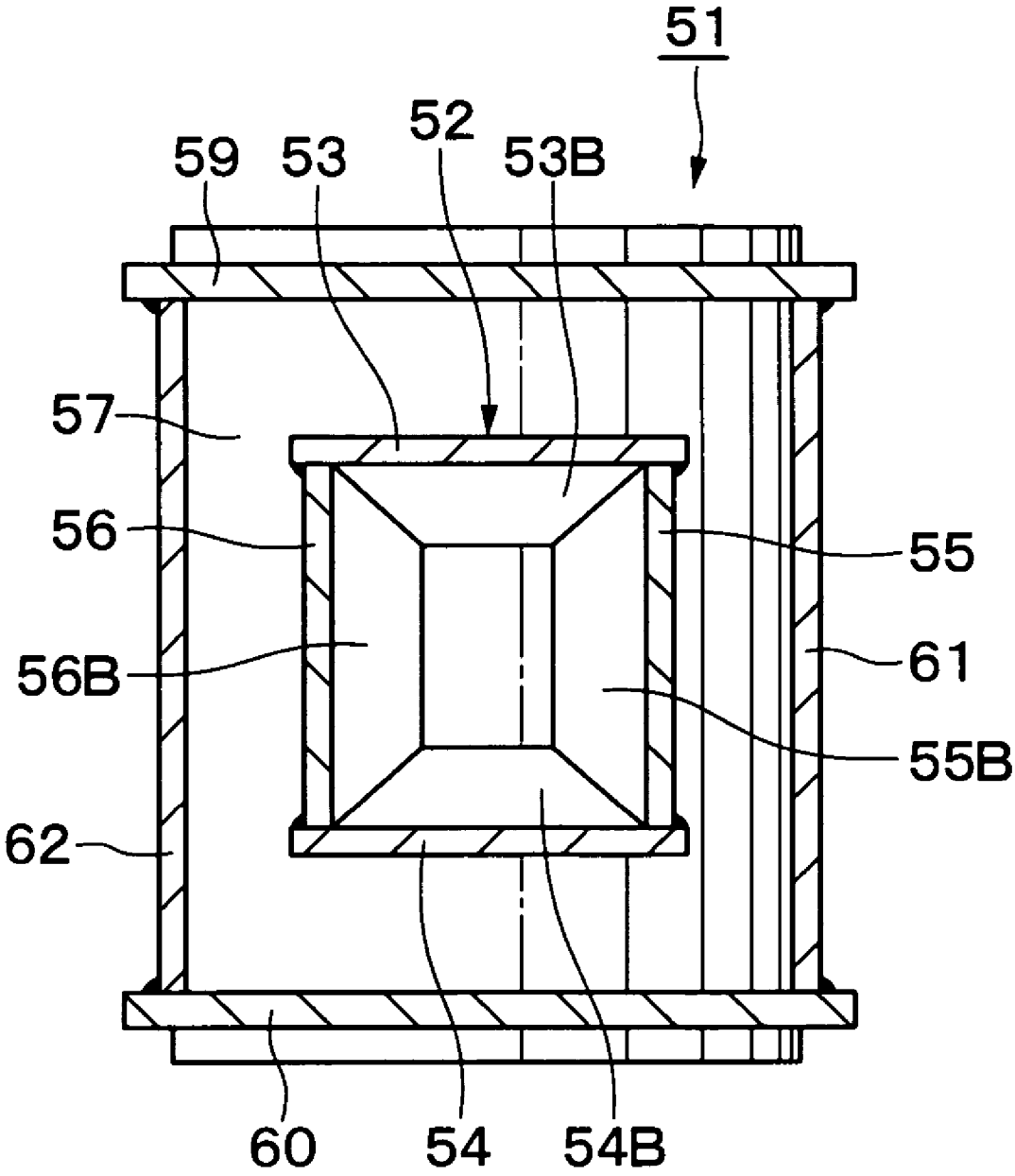
FIG. 17 is an enlarged, vertical cross-sectional view of the upper boom, taken in the direction of arrows XVII-XVII in FIG. 16.
Figure 18:
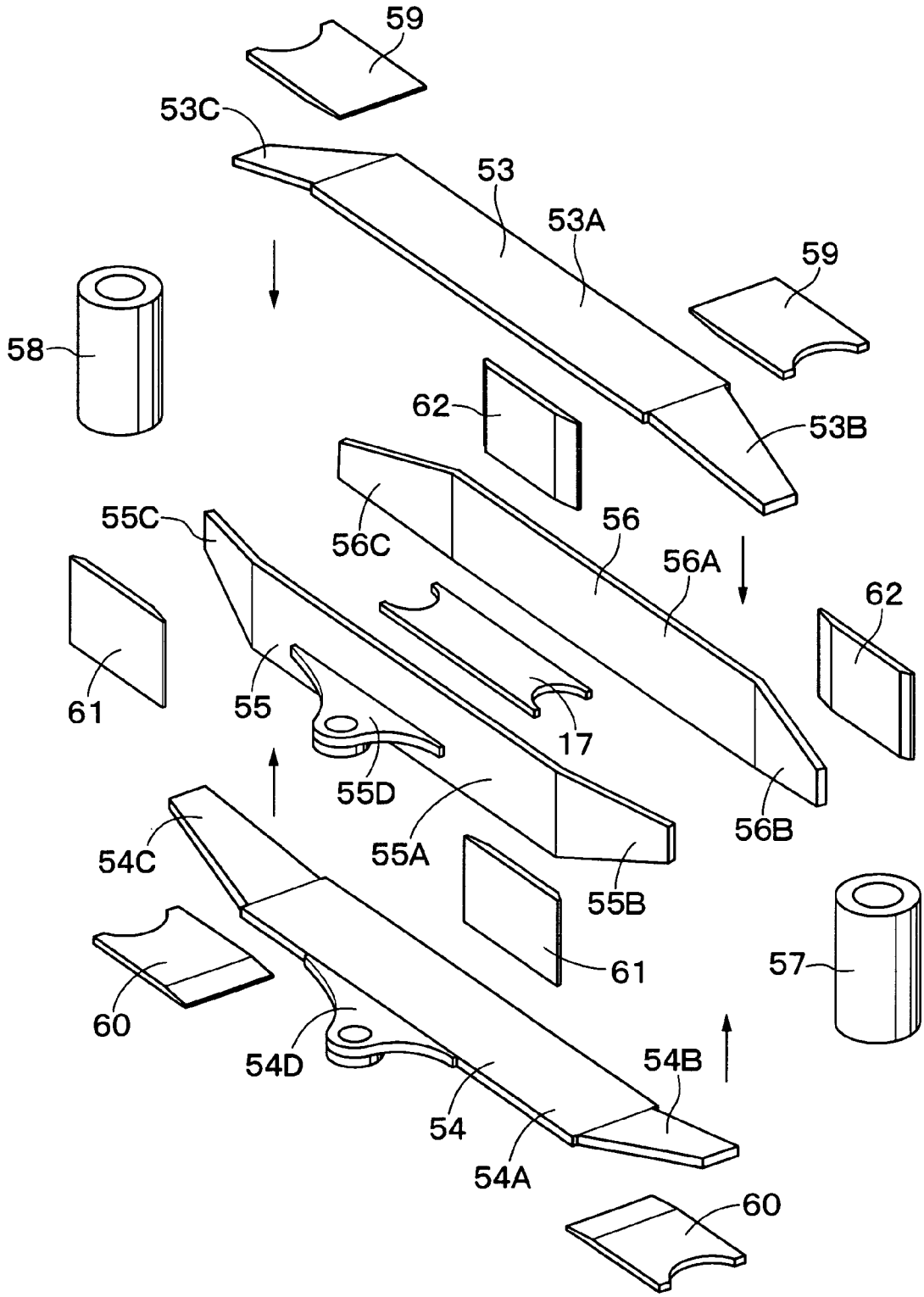
FIG. 18 is an enlarged exploded perspective view of the upper boom in the exploded state.

As shown in FIG. 17, of the reinforcement plates 59 to 62, the upper reinforcement plate 59, the lower reinforcement plate 60, the left reinforcement plate 61 and the right reinforcement plate 62 that are located near the base end of the upper boom 51 are welded to the shape like a box at the position where the bent plate portions 53B, 54B, 55B, 56B are enclosed, and are welded to the base end boss 57, constituting a double cylindrical body together with these bent plate portions 53B to 56B.

Substantially in the same manner as the reinforcement plates located near the base end, the upper reinforcement plate 59, the lower reinforcement plate 60, the left reinforcement plate 61 and the right reinforcement plate 62 are welded together at the position where the bent plate portions 53C, 54C, 55C, 56C are enclosed, and are welded to the distal end boss 58, constituting a double cylindrical body together with these bent plate portions 53C to 56C.

In addition, the upper reinforcement plates 59 and the lower reinforcement plates 60 are arranged continuously and respectively, substantially on the same planes as the upper face plate portion 53A of the upper flange 53 and the lower face plate portion 54A of the lower flange 54. Further, the left reinforcement plates 61 and the right reinforcement plates 62 are arranged continuously and respectively, substantially on the same vertical planes as the left side face plate portion 55A of the left web 55 and the right side face plate portion 56A of the right web 56.

Therefore, in the fourth embodiment having the above described arrangement, almost the same effects can be obtained as are obtained in the first and the third embodiments. Especially in this embodiments, the bent plate portions 53B, 54B, 55B, 56B are provided near the base end of the upper boom 51, and the reinforcement plates 59, 60, 61, 62 are arranged outside of these portions. Similarly, the bent plate portions 53C to 56C are also provided near the distal end of the upper boom 51, and another reinforcement plates 59 to 62 are arranged outside of these portions.

Thus, on the base end of the box member 52, the bent plate portions 53B to 56B on four sides can be welded to form a shape like a box, and at the position where these portions are externally enclosed. The reinforcement plates 59 to 62 on the four sides can be welded to form a shape like a box. Further, also on the distal end of the box member 52, the bent plate portions 53C to 56C on the four sides and other reinforcement plates 59 to 62 can be welded together to form shapes like boxes. Therefore, the both ends of the upper boom 51 can be structured and shaped like a double box, and the strength of the upper boom 51 can be considerably increased at these portions.

Figure 19:
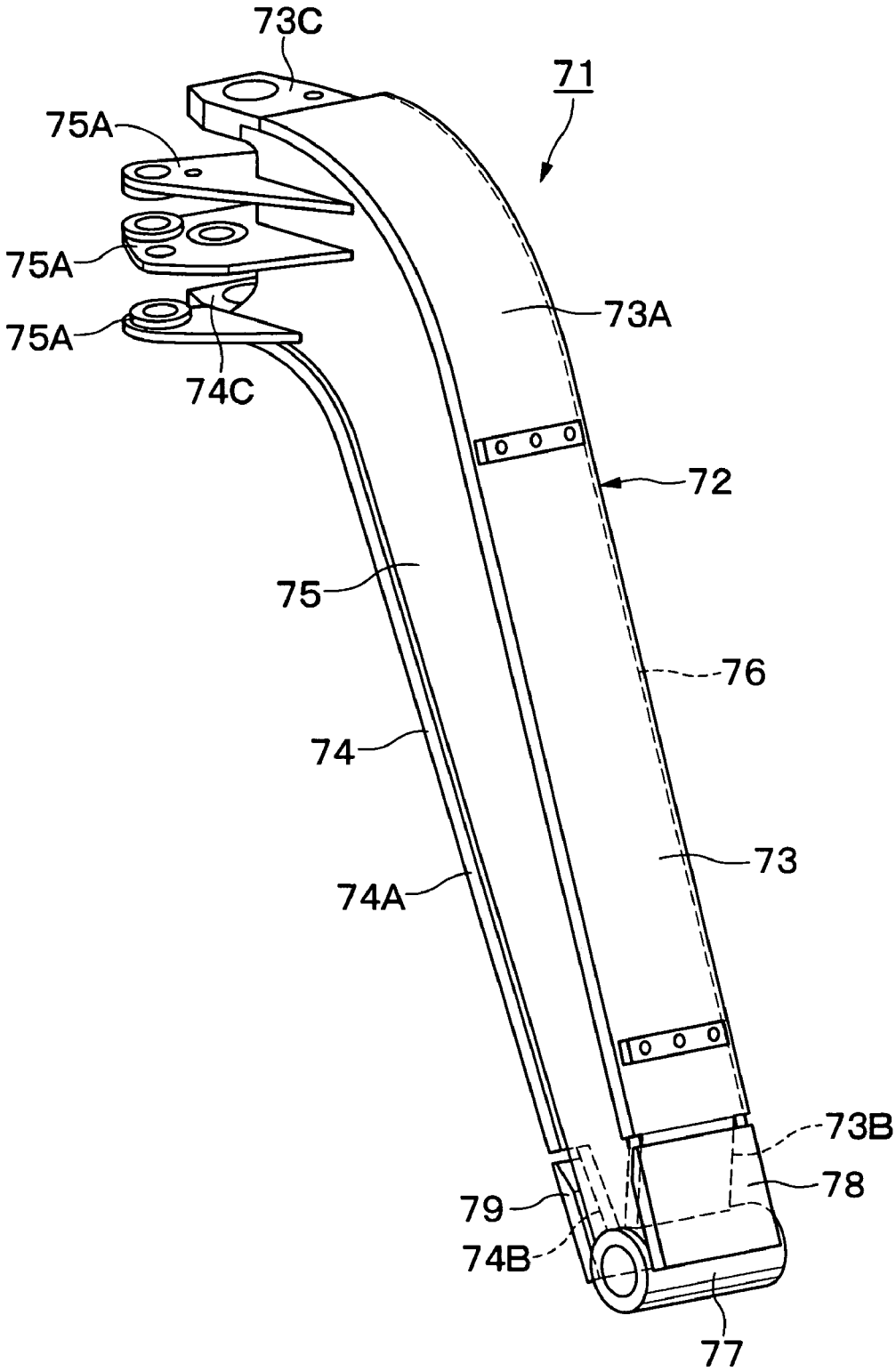
FIG. 19 is a perspective view of a lower boom according to a fifth embodiment of the present invention.

The fifth embodiment for a front device according to the present invention is shown in FIG. 19. The characteristic of this embodiment is applied for the lower boom of a working mechanism of an offset boom type.

Indicated at 71 is a lower boom that serves as a front device. The lower boom 71 is used as a lower boom 4A (see FIGS. 1 and 2) of a working mechanism 4 of an offset boom type. In this case, the lower boom 71 is, for example, an elongated hollow structure having the shape of a box in transverse cross section and having a curved distal end, and is extended in the front and the rear directions of a vehicle body. Further, the lower boom 71 is constituted by a box member 72, a vehicle body boss 77 and reinforcement plates 78, 79 that will be described later.

Indicated at 72 is a box member that serves as the main body of the lower boom 71. Substantially in the same manner as the first embodiment, the box member 72 is formed like a square column as a whole by welding, together with an upper flange 73, a lower flange 74, a left web 75 and a right web 76 that will be described later.

Denoted at 73 is an upper flange that serves as the upper face of the box member 72. Similarly to the third embodiment, the upper flange 73 is constituted by an upper face plate portion 73A with the distal end being bent, and a bent plate portion 73B which is integrally formed with the base end of the upper face plate portion 73A. A bracket 73C is securely attached to the distal end of the upper flange 73, and an upper boom 4B (see FIG. 2) of the working mechanism 4 is connected between the bracket 73C and a bracket 74C of the lower flange 74 that will be described later.

Reference numeral 74 denotes a lower flange that serves as the lower face of the box member 72. Substantially in the same manner as the upper flange 73, the lower flange 74 is formed of a lower face plate portion 74A, a bent plate portion 74B. The lower flange 74 is faced to the upper flange 73 at an interval, and a bracket 74C is provided at the distal end.

Indicated at 75 is a left web that serves as the left side face of the box member 72. The left web 75 is provided vertically between the upper flange 73 and the lower flange 74, and is welded between them along almost the entire length. In addition, a plural number of brackets 75A are projected from the distal end of the left web 75 to attach, for example, an offset cylinder 4G and a link 4K of the working mechanism 4 (see FIG. 2).

Indicated at 76 is a right web that serves as the right side face of the box member 72. The right web 76 is faced to the left web 75 at an interval, and is welded between the upper flange 73 and the lower flange 74 along almost the entire length.

Denoted at 77 is a vehicle body boss which is provided at the base end of the box member 72. The bent plate portion 73B of the upper flange 73, the bent plate portion 74B of the lower flange 74, the left web 75, the right web 76 and reinforcement plates 78, 79 are welded to the outer surface of the vehicle body boss 77. And the vehicle body boss 77 of the lower boom 71 is rotatably connected to the vehicle body of a hydraulic excavator by use of a connecting pin (not shown).

Indicated at 78 is an upper reinforcement plate that is provided outside of the bent plate portion 73B of the upper flange 73. The upper reinforcement plate 78 is welded between the bent plate portion 73B and the vehicle body boss 77, and is also welded to the left and right webs 75, 76.

Reference numeral 79 denotes a lower reinforcement plate that is provided outside of the bent plate portion 74B of the lower flange 74. Substantially in the same manner as the upper reinforcement plate 78, the lower reinforcement plate 79 is welded to the bent plate portion 74B, the left and right webs 75, 76 and the vehicle body boss 77.

Therefore, in the fifth embodiment having the above described arrangement, almost the same effects as in the first and third embodiments can also be obtained. Especially, this embodiment can be applied for the lower boom 71 of a working mechanism of an offset boom type, and objects for the usage can be increased.

Figure 20:
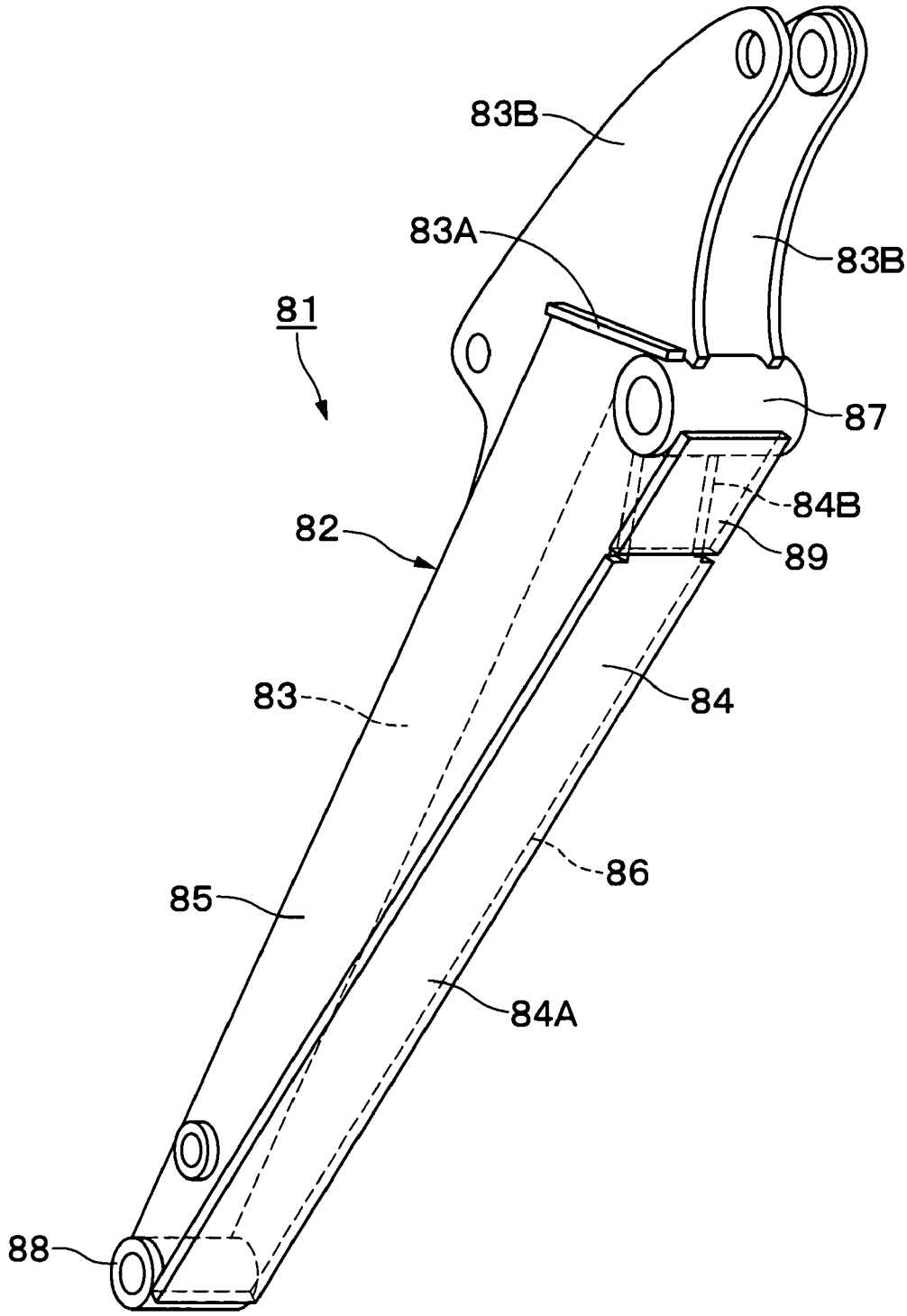
FIG. 20 is a perspective view of an arm according to a sixth embodiment of the present invention.

The sixth embodiment for a front device according to the present invention is shown in FIG. 20. The characteristic of this embodiment is applied for the arm of a working mechanism.

Denoted at 81 is an arm that serves as a front device, and that is used as an arm 4D (see FIGS. 1 and 2) of a working mechanism 4 of an offset boom type. In this case, the arm 81 is formed as an elongated hollow structure having the shape of a box in transverse cross section, and is constituted by a box member 82, bosses 87, 88 and a lower reinforcement plate 89 that will be described later.

Indicated at 82 is a box member that serves as the main body of the arm 81. Substantially in the same manner as the first embodiment, the box member 82 is formed like a square column as a whole by welding together, for example, an upper flange 83, a lower flange 84, a left web 85 and a right web 86 that will be described later.

Reference numeral 83 denotes an upper flange that serves as the upper face of the box member 82, and is made of a flat steel plate. An end face plate 83A that serves as one part of the upper flange 83 is provided at the base end, and a pair of brackets 83B are welded to the end face plate 83A. An arm cylinder 4H (see FIG. 2) for rotating the arm 81 is connected to these brackets 83B.

Indicated at 84 is a lower flange that serves as the lower face of the box member 82, and is made of a flat steel plate. The lower flange 84 is constituted by a lower face plate portion 84A, and a bent plate portion 84B which is integrally formed with the base end of the lower face plate portion 84A and is bent inwardly.

Denoted at 85 is a left web that serves as the left side face of the box member 82, and reference numeral 86 denotes a right web that serves as the right side face of the box member 82. Between the upper flange 83 and the lower flange 84, these left and right webs 85, 86 are arranged uprightly at a transverse interval, and are welded along almost the entire length. The base ends of the left and right webs 85, 86 are welded to the end face plate 83A of the upper flange 83.

Indicated at 87 is a boom boss located close to the base end of the box member 82. The boom boss 87 is a portion to which an arm support member 4C (see FIG. 2) of the working mechanism 4 is rotatably connected by a pin. In addition, the upper flange 83 (the end face plate 83A), the bent plate portion 84B of the lower flange 84, the left web 85, the right web 86 and the lower reinforcement plate 89 are welded to the outer face of the boom boss 87.

Denoted at 88 is a bucket boss located close to the distal end of the box member 82. The bucket boss 88 is a portion to which a bucket 4E (see FIG. 2) of the working mechanism 4 is rotatably connected by a pin. Further, the upper flange 83, the lower flange 84, the left web 85 and the right web 86 are welded to the outer face of the bucket boss 88.

Indicated at 89 is a lower reinforcement plate which is provided outside of the bent plate portion 84B of the lower flange 84. Substantially in the same manner as in the third embodiment, the lower reinforcement plate 89 is welded between the bent plate portion 84B and the boom boss 87, and is also welded to the left and the right webs 85, 86.

Thus, also in the sixth embodiment having the above described arrangement, almost the same effects as the first and third embodiments can be obtained. Especially this embodiment can be applied for the arm 81 of the working mechanism, and objects for application can be increased.

Figure 21:
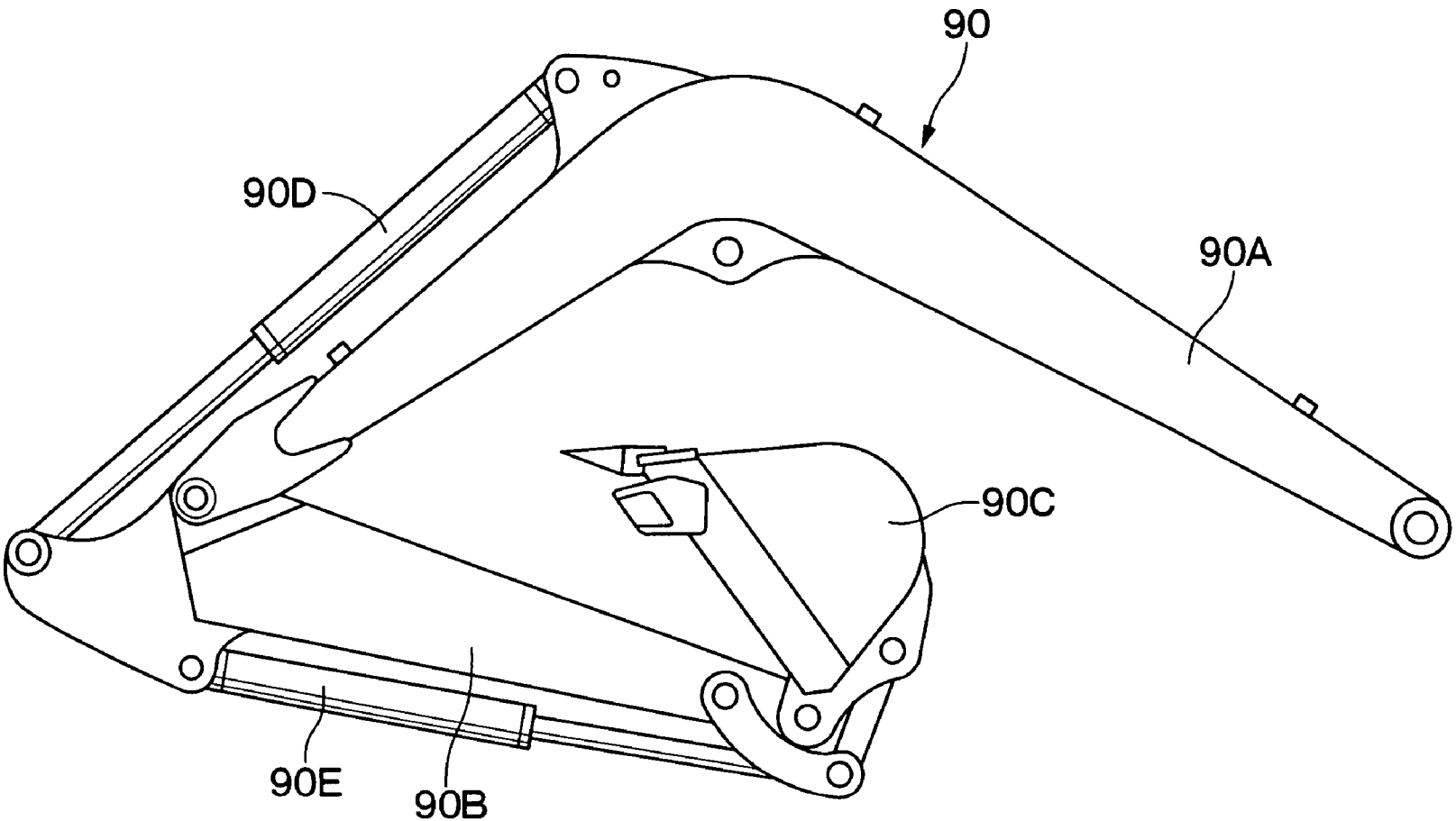
FIG. 21 is a front view of a working mechanism of a hydraulic excavator applied for a seventh embodiment of the present invention.
Figure 22:
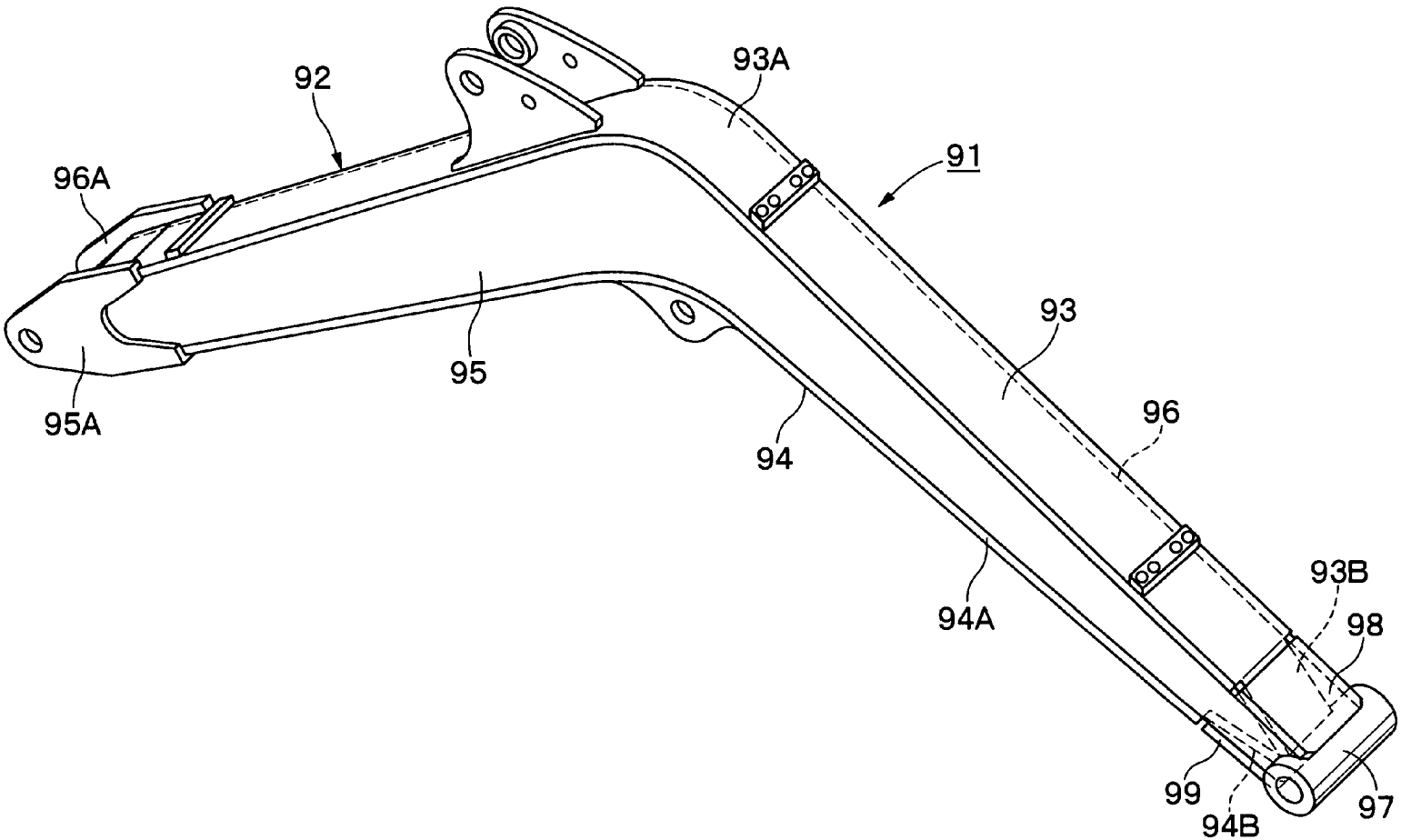
FIG. 22 is a perspective view of a boom according to the seventh embodiment of the present invention.

A seventh embodiment for a front device according to the present invention is shown in FIGS. 21 and 22. The characteristic of this embodiment is that a front device is applied for a standard hydraulic excavator, a working mechanism of whish is mounted liftably to the upward and the downward directions relative to a vehicle body.

Reference numeral 90 denotes a working mechanism that is liftably provided to the vehicle body (not shown) of a hydraulic excavator. The working mechanism 90 is roughly constituted by a boom 90A the base end of which is liftably connected to the vehicle body, an arm 90B which is rotatably connected to the distal end of the boom 90A, a bucket 90C as a work tool which is rotatably connected to the distal end of the arm 90B, a boom cylinder (not shown), and an arm cylinder 90D and a bucket cylinder 90E, which operate these components.

Indicated at 91 is a boom as a front device, and is used as the boom 90A of the working mechanism 90. In this case, as shown in FIG. 22, the boom 91 is, for example, formed as an elongated hollow structure which is curved like a crescent shape having the shape of a box in transverse cross section, and constituted by a box member 92, a vehicle body boss 97 and reinforcement plates 98, 99 which will be described later.

Denoted at 92 is a box member that serves as the main body of the boom 91. Substantially in the same manner as the first embodiment, the box member 92 is constituted by an upper flange 93, a lower flange 94, a left web 95 and a right web 96 that are welded together, and which will be described later.

Indicated at 93 is an upper flange that serves as the upper face of the box member 92. The upper flange 93 is constituted by an upper face plate portion 93A that is bent and formed like a crescent, and a bent plate portion 93B that is integrally formed with the base end of the upper face plate portion 93A, and is bent inward. Indicated at 94 is a lower flange that serves as the lower face of the box member 92. Similarly to the upper flange 93, the lower flange 94 is constituted by a lower face plate portion 94A and a bent plate portion 94B.

Reference numeral 95 denotes a left web that serves as the left side face of the box member 92, and indicated at 96 is a right web that serves as the right side face of the box member 92. The left and right webs 95, 96 are welded between the upper flange 93 and the lower flange 94 substantially along the entire length. Further, brackets 95A, 96A for connecting the arm 90B are provided at the distal ends of the left and right webs 95, 96.

Denoted at 97 is a vehicle body boss located near the base end of the box member 92. The bent plate portion 93B of the upper flange 93, the bent plate portion 94B of the lower flange 94, the left web 95, the right web 96 and reinforcement plates 98, 99 are welded to the outer surface of the vehicle body boss 97. And the boom 91 is rotatably connected to the vehicle body of the hydraulic excavator by the vehicle body boss 97 through a connecting pin (not shown).

Indicated at 98 is an upper reinforcement plate which is provided outside of the bent plate portion 93B of the upper flange 93. The upper reinforcement plate 98 is welded to the bent plate portion 93B, the left and right webs 95, 96 and the vehicle body boss 97. Further, indicated at 99 is a lower reinforcement plate which is provided outside of the bent plate portion 94B of the lower flange 94. Substantially in the same manner as the upper reinforcement plate 98, the lower reinforcement plate 99 is welded to the bent plate portion 94B, the left and right webs 95, 96 and the vehicle body boss 97.

Thus, in the seventh embodiment having the above described arrangement, almost the same effects as the first and third embodiments can be obtained. Especially, this embodiment can also be applied for a working mechanism 90 other than the offset boom type, and objects for the application can be increased.

According to the arrangement of the second embodiment mentioned above, the bent plate portion 15B has been provided only for the left web 15 of the upper boom 31 for the arrangement of the left reinforcement plates 20, and a flat steel plate has been employed for the right web 32. However, the present invention is not limited to this arrangement. Bent plate portions may be provided only for the right web of the upper boom 31 for the arrangement of the right reinforcement plates, and a flat steel plate may be employed for the left web.

Similarly, according to the arrangement of the third embodiment, the bent plate portions 43B, 43C have been provided for the upper flange 43 of the upper boom 41 for the arrangement of the upper reinforcement plates 49, and also the bent plate portions 44B, 44C have been provided for the lower flange 44 for the arrangement of the lower reinforcement plates 50. However, the present invention is not limited to this arrangement. Bent plate portions may be provided for either the upper flange or the lower flange for the arrangement of reinforcement plates, and the other flange may be formed of a flat steel plate.

Furthermore, according to the arrangement of the fourth embodiment, the bent plate portions 53B to 56B, 53C to 56C have been provided for the upper flange 53, the lower flange 54, the left web 55 and the right web 56 of the upper boom 51 for the arrangement of the reinforcement plates 59 to 62. However, the present invention is not limited to this arrangement. Bent plate portions and reinforcement plates may be arranged along two or three adjacent sides of the four sides that consist of the upper flange, the lower flange, the left web and the right web, and the other sides may be formed of flat steel plates, for example.

Further, according to the arrangements form the first to the fourth embodiments, the bent plate portions have been provided to the base end and distal end of the front device for the arrangement of the reinforcement plates. However, the present invention is not limited to this. Bent plate portions and reinforcement plates may be located at either the base end or the distal end of a front device, and these components may not be arranged at the other end.

In addition, according to the arrangements from the first to the fourth embodiments, the bent plate portions and the reinforcement plates are provided at the individual positions of the upper booms 11, 31, 41, 51. However, these embodiments are not limited to the upper booms, the arrangement of the bent plate portions and the reinforcement plates from the first to the fourth embodiments can be applied for the lower boom 71, the arm 81 and the boom 91 from the fifth to the seventh embodiments.

Moreover, in the embodiments, the case wherein the invention is applied for the hydraulic excavator 1 has been explained as an example. However, the present invention is not limited to this, and may be applied for another construction machine including a hydraulic crane.

The invention claimed is:

1. A front device including a box member formed by welding together an upper flange, a lower flange, a left web and a right web; and a boss located at least at one end of said box member and welded to the ends of said upper flange, said lower flange, said left web and said right web, characterized in that:

at least one of said left web and said right web is provided with a face plate portion which is extended in the longitudinal direction of said box member and formed as at least one of the left side face and the right side face of said box member, and a bent plate portion which is bent inward and extended from the end of the longitudinal direction of said face plate portion to said boss, and welded to said boss at one end of said bent plate portion;

a reinforcement plate is located outside of said bent plate portion and welded to said face plate portion of said left web or said right web and said boss respectively; and the portion of said box member to be welded to said boss forms a double structure by use of said bent plate portion and said reinforcement plate.

2. A front device including a box member formed by welding together an upper flange, a lower flange, a left web and a right web; and a boss located at least at one end of said box member and welded to the ends of said upper flange, said lower flange, said left web and said right web, characterized in that:

at least one of said upper flange and said lower flange is provided with a face plate portion which is extended in the longitudinal direction of said box member and formed as at least one of the upper side face and the lower side face of said box member, and a bent plate portion which is bent inward and extended from the end of the longitudinal direction of said face plate portion to said boss, and welded to said boss at the distal end of said bent plate portion;

a reinforcement plate is located outside of said bent plate portion and welded to said face plate portion of said upper flange or said lower flange and said boss respectively; and the portion of said box member to be welded to said boss forms a double structure by use of said bent plate portion and said reinforcement plate.

3. A front device including a box member formed by welding together an upper flange, a lower flange, a left web and a right web; and a boss located at least at one end of said box member and welded to the ends of said upper flange, said lower flange, said left web and said right web, characterized in that:

at least one of said left web and said right web is provided with a face plate portion which is extended in the longitudinal direction of said box member and formed as at least one of the left side face and the right side face of said box member, and a first bent plate portion which is bent inward and extended from the end of the longitudinal direction of said face plate portion to said boss, and welded to said boss at the distal end of said bent plate portion;

at least one of said upper flange and said lower flange is provided with a face plate portion which is extended in the longitudinal direction of said box member and formed as at least one of the upper side face and the lower side face of said box member, and a second bent plate portion which is bent inward and extended from the end of the longitudinal direction of said face plate portion to said boss, and welded to said boss at the distal end of said bent plate portion;

a first reinforcement plate is located outside of said first bent plate portion and welded to said face plate portion of said left web or said right web and said boss respectively; and a second reinforcement plate is located outside of said second bent plate portion and welded to said face plate portion of said upper flange or said lower flange and said boss respectively.

4. A front device as defined in claim 1, wherein said box member serves as at least one component of a lower boom which is liftably coupled with the body of a construction machine, an upper boom which is pivotally coupled with the distal end of said lower boom for swinging movements in leftward and rightward directions, or an arm which is rotatably coupled with the distal end of said upper boom through an arm support member and to which a work tool is attached.

5. A front device as defined in claim 1, wherein said box member serves as at least one component of a boom which is liftably coupled with the body of a construction machine, and an arm which is rotatably coupled with the distal end of said boom and to which a work tool is attached.

* * * * *